US011365034B2

(12) United States Patent
Bressan et al.

(10) Patent No.: US 11,365,034 B2
(45) Date of Patent: Jun. 21, 2022

(54) CHILDPROOF CONTAINER AND PROCESS FOR MAKING THE SAME

(71) Applicant: I.G.B. S.r.l., Milan (IT)

(72) Inventors: Michel Bressan, Induno Olona (IT); Alessio Bressan, Varese (IT); Alberto Gandolla, Induno Olona (IT)

(73) Assignee: I.G.B. S.R.L, Milan (IT)

( * ) Notice: Subject to any disclaimer, the term of this patent is extended or adjusted under 35 U.S.C. 154(b) by 0 days.

(21) Appl. No.: 16/852,439

(22) Filed: Apr. 18, 2020

(65) Prior Publication Data

US 2020/0331667 A1 Oct. 22, 2020

(30) Foreign Application Priority Data

Apr. 19, 2019 (IT) ..... 102019000006148

(51) Int. Cl.
*B65D 50/04* (2006.01)
*B65D 5/66* (2006.01)
(Continued)

(52) U.S. Cl.
CPC ..... *B65D 50/045* (2013.01); *B65D 5/6608* (2013.01); *B31B 50/20* (2017.08);
(Continued)

(58) Field of Classification Search
CPC .. B65D 50/045; B65D 5/6608; B65D 5/6602; B65D 5/6623; B65D 2215/04;
(Continued)

(56) References Cited

U.S. PATENT DOCUMENTS 2,711,282 A 6/1955 D'Esposito
3,692,231 A * 9/1972 Neitzke ..... B65D 5/4295 229/125.29
(Continued)

FOREIGN PATENT DOCUMENTS

BE 410524 A 8/1935
DE 202014001622 U1 * 4/2014 ..... B65D 5/6608
(Continued)

OTHER PUBLICATIONS

Early Search Report for Italian Patent Application No. 201900006148, Ministero dello Sviluppo Economico, Munich, dated Oct. 21, 2019.

*Primary Examiner* — J. Gregory Pickett
*Assistant Examiner* — Abigail Elizabeth Guidry

(57) ABSTRACT

The present invention relates to a childproof container comprising a store, for housing a product, and a closure system configured to define a closing condition and an opening condition of the container. The container comprises a safety device having a first coupling portion carried by the closure system and a second coupling portion engaged to the store and configured to cooperate with the first coupling portion to define a locking condition in which the first and second coupling portions prevent the closure system from switching from the closing to the opening condition. The store comprises an unlocking portion located on a side wall of the store and defining a through access configured to allow, in the locking condition, the insertion in the store of an opening device to allow the disengagement between the first and second coupling portions.

18 Claims, 11 Drawing Sheets

(51) Int. Cl.

| | |
|---|---|
| *B31B 50/20* | (2017.01) |
| *B31B 120/30* | (2017.01) |
| *B31B 50/62* | (2017.01) |
| *B31B 50/73* | (2017.01) |
| *B31B 110/35* | (2017.01) |
| *B31B 50/26* | (2017.01) |

(52) U.S. Cl.
CPC ..... *B31B 50/26* (2017.08); *B31B 50/624* (2017.08); *B31B 50/734* (2017.08); *B31B 2110/35* (2017.08); *B31B 2120/302* (2017.08)

(58) Field of Classification Search
CPC ..... B65D 2215/02; B65D 2401/00; B65D 5/2057; B65D 5/665; B31B 50/20; B31B 50/624; B31B 50/734; B31B 50/26; B31B 50/48; B31B 50/50; B31B 50/14; B31B 50/22; B31B 50/732; B31B 2110/35; B31B 2120/302; E05B 73/0023
See application file for complete search history.

(56) References Cited

U.S. PATENT DOCUMENTS

| | | | | |
|---|---|---|---|---|
| 4,535,929 | A | 8/1985 | Sherman, II et al. | |
| 5,505,373 | A * | 4/1996 | von Stillfried | B65D 5/0254 229/122 |
| 5,507,428 | A * | 4/1996 | Robinson, Jr. | B65D 5/0254 229/102 |
| 6,491,211 | B1 | 12/2002 | Evans et al. | |
| 8,939,281 | B2 * | 1/2015 | Matsuba | B65D 25/00 206/1.5 |
| 10,099,853 | B2 * | 10/2018 | Miller | B65F 1/00 |
| 2004/0035718 | A1 * | 2/2004 | Waga | B65D 5/5425 206/1.5 |
| 2007/0017963 | A1 * | 1/2007 | Robinson | B65D 5/0254 229/148 |
| 2008/0308619 | A1 * | 12/2008 | Adam | B65D 5/6608 229/222 |
| 2010/0252618 | A1 * | 10/2010 | Adam | B65D 5/6608 229/102 |
| 2012/0234701 | A1 * | 9/2012 | Albrecht | B65D 83/0463 206/1.5 |
| 2015/0136619 | A1 * | 5/2015 | Scott | B65D 55/06 206/1.5 |
| 2015/0307246 | A1 * | 10/2015 | Patwardhan | B65D 55/02 206/1.5 |
| 2016/0272362 | A1 * | 9/2016 | Grajales | B65D 5/4266 |
| 2017/0043929 | A1 * | 2/2017 | Bressan | B65D 5/10 |
| 2018/0244425 | A1 * | 8/2018 | Bressan | B65D 75/70 |
| 2019/0009944 | A1 * | 1/2019 | Bressan | B65D 5/46 |
| 2019/0100346 | A1 * | 4/2019 | Bressan | B65D 5/665 |
| 2020/0180808 | A1 * | 6/2020 | Gauvin | B65D 5/38 |
| 2020/0277106 | A1 * | 9/2020 | Bressan | B65D 27/34 |
| 2021/0016939 | A1 * | 1/2021 | Palmer | B65D 5/38 |
| 2021/0047072 | A1 * | 2/2021 | Ng Pak Leung | B65D 5/6608 |

FOREIGN PATENT DOCUMENTS

| | | | | |
|---|---|---|---|---|
| EP | 3778412 | A1 * | 2/2021 | C11D 17/04 |
| EP | 3835228 | A1 * | 6/2021 | B65D 77/0453 |
| GB | 2566555 | A * | 3/2019 | B65D 75/367 |
| JP | 11245940 | A2 | 9/1999 | |
| JP | 2014141276 | A2 | 8/2014 | |
| WO | 2016198978 | A1 | 12/2016 | |
| WO | WO-2021044266 | A1 * | 3/2021 | B65D 5/665 |
| WO | WO-2021044267 | A1 * | 3/2021 | B65D 5/685 |
| WO | WO-2021044269 | A1 * | 3/2021 | B65D 5/685 |
| WO | WO-2021044270 | A1 * | 3/2021 | B65D 5/685 |

* cited by examiner

CHILDPROOF CONTAINER AND PROCESS FOR MAKING THE SAME

FIELD OF THE INVENTION

The present invention relates to a childproof container and a process of making the same. The container may be used in fields that require the packaging of products and where it is required, for safety reasons, the inhibition of opening the container by children. For example, the container may be used in the pharmaceutical, cosmetic and food fields.

BACKGROUND

As is well known, childproof containers are available on the market designed to be difficult to open by children under 5 years of age; this type of container is used in the pharmaceutical field, for example, to prevent children from ingesting pharmaceuticals potentially harmful to them.

A type of childproof container is described in PCT patent application No. WO 2016/198978 A1; said container comprises an openable/closable store by means of a closure system associated with the store. The closure system carries a coupling portion suitable to cooperate, in the closed condition of the container, with a respective coupling portion located inside the store. The closure system has a slot act to allow the insertion of an opening device configured to disengage the coupling portions of the store and the closure system for opening the container.

Although the container described in the patent application WO 2016/198978 A1 defines an efficient childproof system, the Applicant found that the presence of the second coupling portion located inside the store requires special attention during the construction phase of the container in order to allow the first coupling (engage) between the first and second coupling portion.

OBJECT OF THE INVENTION

The object of the present invention is therefore to substantially solve at least one of the disadvantages and/or limitations of the preceding solutions.

A first object of the present invention is to provide a child-proof container with a simple and compact structure, which can be realized quickly and economically; in particular, it is object of the present invention to realize a container that does not require the modification of the common systems used today for the realization of standard type containers and that also do not require the modification of the today's used existing packaging plants for the filling of the container itself.

It is purpose of the present invention is to provide a container having a structure that makes it easier to close it in the machine, minimizing the possibility of an incorrect first closure (engagement) of the container. It is also purpose of the present invention to make available a container that can effectively inhibit the opening of the same by a child but at the same time can be easily opened by an adult. It is also the purpose of the present invention to provide a container flexible in its use that can be opened by an adult with different and common opening devices. It is also the purpose of the present invention to provide a container having a stable structure able to guarantee its integrity following multiple openings and closures of the same.

These purposes and others, which will appear more from the following description, are substantially achieved by a container and a process of making the same according to what is expressed in one or more of the enclosed claims and/or in the following aspects.

SUMMARY

In an aspect a childproof container is provided comprising:

- a store made of sheet material defining an internal volume configured to house at least one product, the store having a prefixed number of side walls defining at least one passage opening delimited by a free edge, said passage opening being configured to put in communication the internal volume of the store with the external environment,
- at least one closure system also made of sheet material engaged at the free edge and movable with respect to the store, the closure system being configured to define at least one closing condition in which the closure system itself interdicts the communication between the internal volume of the store and the external environment, the closure system being also configured to define an opening condition in which the closure system itself allows the communication between the internal volume and the external environment,
- at least a safety device made of sheet material exhibiting:
  - at least a first coupling portion carried by the closure system,
  - at least a second coupling portion engaged to the store and configured to cooperate with said first coupling portion,
- wherein the first and second coupling portions are configured to stably engage with each other in the internal volume of the store in the closing condition of the closure system to define a locking condition of the safety device in which said first and second coupling portions prevent the closure system from switching from the closing to the opening condition, wherein the store comprises at least an unlocking portion defined on at least one side wall of said prefixed number of side walls, said unlocking portion being configured to define at least one through access, said through access being configured to allow, at least in the locking condition of the safety device, the disengagement between the first and the second coupling portions.

In a further aspect according to the preceding aspect the through access of the unlocking portion is spaced from the free edge of the store.

In a further aspect according to any one of the preceding aspects, the closure system comprises at least closure portion engaged at the free edge of the store and at least one inserting portion configured to be inserted, in the closing condition of the closure system, into the internal volume of the store. In a further aspect according to any one of the preceding aspects, the first coupling portion is directly carried by the inserting portion of the closure system. In a further aspect according to any one of the preceding aspects the first coupling portion emerges from the graft portion on one side opposite to that from which the closing portion emerges.

In a further aspect according to any one of the preceding aspects, the second coupling portion is directly carried by at least one side wall of said prefixed number of side walls of the store. In a further aspect according to any one of the preceding aspects the second coupling portion is entirely arranged in the internal volume of the store.

In a further aspect according to any one of the preceding aspects the closure system emerges in extension from a first side wall of said prefixed number of side walls, the second coupling portion being directly carried by a second side wall of said prefixed number of side walls and being entirely arranged in the internal volume of the store.

In a further aspect according to any one of the preceding aspects the second side wall of the store directly carrying the second coupling portion is opposed to the first side wall of the store from which the closure system emerges.

In a further aspect according to any one of the preceding aspects the first side wall is a front wall of the store while the second side wall is a rear wall of the store.

In a further aspect according to any one of the preceding aspects the through access of the unlocking portion is configured to allow, in the locking condition of the safety device, the access to the internal volume to allow the disengagement between the first and second coupling portions.

In a further aspect according to any one of the preceding aspects the through access of the unlocking portion is configured to allow, at least in the locking condition of the safety device, at least the partial insertion of an opening device and/or at least a user finger into the internal volume of the store allowing the intervention on the safety device (optionally the disengagement of the first and second coupling portions).

In a further aspect according to any one of the preceding aspects the through access of the unlocking portion is configured to allow a user, at least in the locking condition of the safety device, to reach, from the outside of the container, the first and/or the second coupling portion arranged in the internal volume of the container allowing their disengagement.

In a further aspect according to any one of the preceding aspects the through access of the unlocking portion is configured to allow a user, at least in the locking condition of the safety device, to reach the safety device (the first and/or second coupling portion) by means of at least one between: an opening device and at least one finger of the user itself.

In a further aspect according to any one of the preceding aspects the through access at least partially facing the safety device. In a further aspect according to any one of the preceding aspects the through access of the unlocking portion is at least partly directly facing the second coupling portion.

In a further aspect according to any one of the preceding aspects the through access comprises an opening through the side wall of the store. In a further aspect according to any one of the preceding aspects the through access is delimited by a closed profile.

In a further aspect according to any one of the preceding aspects the through access is defined at a portion of the longitudinal end of the store, in proximity to the free edge. In a further aspect according to any one of the preceding aspects the through access is distinct and spaced from the free edge of the store.

In a further aspect according to any one of the preceding aspects the unlocking portion is defined on at least one between the first and second side walls of the store.

In a further aspect according to any one of the preceding aspects the through access of the unlocking portion is defined on the front wall of the store, optionally directly facing the second coupling portion.

In a further aspect according to any one of the preceding aspects the through access of the unlocking portion defines a substantially "C" or "V" or "U" shape having a predetermined concavity.

In a further aspect according to any one of the preceding aspects the unlocking portion comprises at least a thrust portion movable between:

a thrust condition, in which the thrust portion acts on the safety device allowing the disengagement between the first and second coupling portions, and a rest condition, in which the thrust portion is distanced from the safety device.

In a further aspect according to any one of the preceding aspects, the thrust portion comprises an elastically tab movable between the thrust condition and the rest condition. In a further aspect according to any one of the preceding aspects the thrust portion defines at least part of an external side wall of the store. In a further aspect according to any one of the preceding aspects the thrust portion defines a portion of the front side wall of the store. In a further aspect according to any one of the preceding aspects the thrust portion is arranged at the through access of the unlocking portion. In a further aspect according to any one of the preceding aspects the thrust portion is arranged at least partially inside the concavity defined by the through access of the unlocking portion. In a further aspect according to any one of the preceding aspects the thrust portion acts in thrust directly on one between the first and the second coupling portion. In a further aspect according to any one of the preceding aspects the thrust portion is configured to be moved from the thrust condition to the rest condition:

manually by a user, and/or by a user by means of an opening device.

In a further aspect according to any one of the preceding aspects the thrust portion is configured to act in thrust directly on at least one between the first and second coupling portion. In a further aspect according to any one of the preceding aspects the thrust portion is configured to directly act in thrust on the first coupling portion. In a further aspect according to any one of the preceding aspects the thrust portion is configured to directly act in thrust on the second coupling portion.

In a further aspect according to any one of the preceding aspects the second coupling portion comprises a first and a second panel joined together. In a further aspect according to any one of the preceding aspects the first and second panels of the second coupling portion are folded around a folding edge. In a further aspect according to any one of the preceding aspects the first and second panels of the second coupling portion are substantially facing each other to define a folded tab with a substantially "V" shape. In a further aspect according to any one of the preceding aspects, the folded "V" tab of the second portion of the coupling has a concavity facing outwards from the container. In a further aspect according to any one of the preceding aspects, the "V" folded tab of the second portion of the coupling has a concavity facing, in the closing condition of the closure system, towards the latter.

In a further aspect according to any one of the preceding aspects the first panel is directly connected to the front wall from the store while the second panel is directly connected to the first panel. In a further aspect, according to any one of the preceding aspects, the first panel of the second coupling portion is interposed between the front wall of the store and the second panel of the second coupling portion itself.

In a further aspect according to any one of the preceding aspects the first panel comprises a first and a second ends opposite each other, wherein the first panel is engaged at the free edge of the store, at the first end, wherein the first panel is engaged at the second panel at the second end.

In a further aspect according to any one of the preceding aspects, the second coupling portion comprises a through opening configured to allow, at least in the closing condition of the closure system, the passage of the least part of the first coupling portion allowing the engagement of the first coupling portion to the second coupling portion defining the locking condition.

In a further aspect according to any one of the preceding aspects the through opening is defined at the folding edge of the first and second panel.

In a further aspect according to any one of the preceding aspects at least one between the first and second panel of the second coupling portion defines an undercut configured to stably engage the first coupling portion. In a further aspect according to any one of the preceding aspects, the through opening comprises at least one slot. In a further aspect according to any one of the preceding aspects the through opening is defined at least partly on the second panel and at the folding edge. In a further aspect according to any one of the preceding aspects the through opening is defined at least partly on the second panel and at least partly on the first panel. In a further aspect according to any one of the preceding aspects the through opening is delimited by a closed profile.

In a further aspect according to any one of the preceding aspects, the second panel of the second coupling portion defines an undercut act to stably engage the first coupling portion in the locking condition of the safety device. In a further aspect according to any one of the preceding aspects the through opening defined at least partly on the second panel of the second coupling portion defines on said second panel at least one hook configured to stably engage said first coupling portion. In a further aspect according to any one of the preceding aspects the hook defined on the second panel of the second coupling portion defines a seat suitable to receive in crossing the first coupling portion during the passage of the closure system from the opening condition to the closing one.

In a further aspect according to any one of the preceding aspects the first coupling portion comprises at least one respective hook configured to constraining to the hook defined on the second panel of the second coupling portion.

In a further aspect according to any one of the preceding aspects the first and second panel of the second coupling portion are movable with respect to each other at least between:

- a locking position in which the first and second panels are angularly offset each other and they are configured to prevent the first coupling portion, in the locking condition, to come out from escaping from the through opening of the second coupling portion, thus preventing the disengagement between the first and second coupling portions,
- a release position in which the first and the second panels are, at least in part, substantially parallel to each other and configured to allow the first coupling portion to come out from the through opening of the second coupling portion thus allowing the disengagement between the first and second coupling portion.

In a further aspect according to any one of the preceding aspects, the thrust portion is configured to act in thrust directly on the second coupling portion to allow the first and second panel of the second coupling portion to be moved from the locking position to the release one.

In a further aspect according to any one of the preceding aspects at least one between the first and second panel of the second coupling portion comprises an unlocking appendix configured to allow the relative movement, optionally the rotation, of the first and second panel between the locking position and the release position.

In a further aspect according to any one of the preceding aspects the unlocking appendix is defined on the second panel of the unlocking portion. In a further aspect according to any one of the preceding aspects the appendix is joined in one piece to the second panel of the second coupling portion. In a further aspect according to any one of the preceding aspects the unlocking appendix extends the second panel of the second coupling portion away from the first panel. In a further aspect according to any one of the preceding aspects the appendix extends from the second panel towards the front wall of the store. In a further aspect according to any one of the preceding aspects the through access is directly facing the appendix and is configured to allow a user to act in thrust (optionally by means of an opening device or a finger of the user itself) on the appendix to move the first and second panel from the locking position to the release position.

In a further aspect according to any one of the preceding aspects the through opening is defined on the first panel of the second coupling portion. In a further aspect according to any one of the preceding aspects the through opening defines an undercut, wherein the first coupling portion is configured to engage the undercut at least in the locking condition of the safety device. In a further aspect according to any one of the preceding aspects the through opening is spaced from the folding edge of the first and second panels.

In a further aspect according to any one of the preceding aspects, the first coupling portion comprises a respective folded portion defined by a respective first and second panel, the first panel of the first coupling portion is directly joined in one piece to the inserting portion of the closure system while the second panel of the first coupling portion is joined in one piece to the first panel of the same portion. In a further aspect, according to any one of the preceding aspects, the first and second panels of the first coupling portion define a folded portion with substantially "V" shape whose concavity, in the closing condition of the closure system, faces outwards from the container. In a further aspect according to any one of the preceding aspects, the concavity of the folded portion of the first coupling portion and the concavity of the second coupling portion, in the closing condition of the closure system, are facing in the same direction pointing outward with respect to the store.

In a further aspect according to any one of the preceding aspects the second panel of the first coupling portion, in the closing condition of the closure system, is configured to pass at least partially through the through opening defined on the first panel of the second coupling portion to define the locking condition of the safety device.

In a further aspect according to any one of the preceding aspects the through access, in the locking condition, is directly facing the first panel of the second coupling portion and it is configured to allow a user (optionally manually or by means of an opening device) to act in thrust directly on the first coupling portion to allow the latter to disengage from the second coupling portion.

In a further aspect according to any one of the preceding aspects the through access, in the locking condition, it is directly facing the first panel of the second coupling portion and is configured to allow a user (optionally manually or by means of an opening device) to act in thrust directly on the second panel of the first coupling portion to allow said second panel of the first coupling portion to escape from the through opening of the first panel of the second coupling portion and thus allow the disengagement between said first and second coupling portion.

In a further aspect according to any one of the preceding aspects, the thrust portion faces the first panel of the second coupling portion and is configured to act in thrust directly on the second panel of the first coupling portion to allow said second panel of the first coupling portion to escape from the through opening of the first panel of the second coupling portion. In a further aspect according to any one of the preceding aspects, the thrust portion is manually movable in thrust against the second panel of the first coupling portion.

In a further aspect according to any one of the preceding aspects, the through opening defined on the second panel of the first coupling portion is substantially facing the through access of the unlocking portion.

In a further aspect according to any one of the preceding aspects, the unlocking portion has at least one constraint element and it is configured to operate between:

an intact condition in which the thrust portion is engaged to said constraining element and said constraining element prevents the thrust portion from acting on the safety device, and a violated condition, in which the thrust portion is disengaged by the said constraining element, in the violated condition the thrust portion being configured to assume the thrust condition.

In a further aspect according to any one of the preceding aspects, the thrust portion is configured to detach from said constraining element, optionally by means of an appropriate thrust on said thrust portion and/or on said constraining element. In a further aspect according to any one of the preceding aspects, the constraining element is configured to irreversibly separate from the thrust portion.

In a further aspect according to any one of the preceding aspects, the passage between the intact condition and the violated condition determines the detachment of the thrust portion from said constraining element and the formation, on the first side wall, of said through access.

In a further aspect according to any one of the preceding aspects, the container comprises an opening device configured to be inserted, at least in the locking condition of the safety device, into the internal volume of the store through said through access to allow the disengagement between the first and the second coupling portions and consequently the passage of the closure system from the closing condition to the opening one.

In a further aspect according to any one of the preceding aspects the opening device is configured to contact the second coupling portion.

In a further aspect according to any one of the preceding aspects, the opening device is configured to act on the folded portion of the second coupling portion to allow the first and the second panel of the second coupling portion itself to pass from the locking position to the release one. In a further aspect according to any one of the preceding aspects, the opening device is configured to act in thrust on the unlocking appendix to allow the first and second panel to move from the locking position to the release one.

In one aspect a method of opening a childproof container is provided according to any one of the preceding aspects, which comprises the following steps:

contact through the through access of the unlocking portion and from the outside of the container at least one between the first and second coupling portion in the locking condition, disengage said first and second coupling portions, following the disengagement of the first and second coupling portions, move the closure portion of the closure system from the closing condition to the open one.

In a further aspect according to any one of the preceding aspects, the disengagement phase of the first and second coupling portions is performed manually by the user or by inserting an opening device into the internal volume.

In a further aspect according to any one of the preceding aspects, the disengagement phase of the first and second coupling portion involves the relative movement of the first and second coupling portions from the locking position to the release position so that the first coupling portion can escape from the through opening of the second coupling portion. In a further aspect according to any one of the preceding aspects, the movement of the first and second panel of the second coupling portion from the locking position to the release one is carried out by direct pushing on the unlocking appendix carried by the second panel of the second coupling portion by means of a manual intervention of a user or by an opening device. In a further aspect according to any one of the preceding aspects the disengagement phase of the first and second coupling portions involves for direct pushing, either manually by a user or by means of an opening device, on the second panel of the first coupling portion to allow the escape of said second panel of the first coupling portion from the through opening defined on the first panel of the second coupling portion. In a further aspect according to any one of the preceding aspects, the pushing on the unlocking appendix carried by the second coupling portion or on the second panel of the first coupling portion may be carried out by manual pushing of the thrust portion according to a direction entering the store.

In one aspect a blank in sheet material for the realization of a container according to any one of the preceding aspects, said blank comprising:

a first sheet comprising at least a first and a second portion interconnected by a central connecting portion, the first sheet comprising at least a first and a second lateral connecting portion, the first portion being interposed between the central connecting portion and the second lateral connecting portion, each of said portions comprising at least two opposed longitudinal edges and two opposing external edges, said first portion, second portion, central connecting portion and lateral connecting portions being joined along the longitudinal edges and aligned along a single connecting direction, the first sheet being configured to form a store and having at least one window or through access at the first or second portion, a second sheet connected to an external edge of the first portion, the second sheet comprising a first and a second portion joined together in one piece, the first portion of the second sheet being interposed between the first portion of the first sheet and the second portion of the second sheet, the first and the second portion of the second sheet being configured to respectively form a closure portion and an inserting portion of a closure system, a third sheet connected to the external edge of the second portion, the third sheet comprising a first portion connected to the external edge of the second portion and a second portion, optionally the third sheet having at least an opening defined at the first portion and/or the second portion, the third sheet being configured to form a second coupling portion of a safety device, optionally wherein the first portion of the third sheet is configured to form the first panel of the second coupling portion and wherein the second portion of the third sheet is configured to form the second panel of the second coupling portion, a fourth sheet comprising at least a portion joined in one piece to the second portion of the second sheet and configured to form a first coupling portion of the safety device.

In a further aspect according to any one of the preceding aspects the blank is in paper sheet material.

In a further aspect according to any one of the preceding aspects the first, second, third and fourth sheet are joined together to form a single sheet.

BRIEF DESCRIPTION OF THE DRAWINGS

Some embodiments and some aspects of the invention will be described below with reference to the accompanying drawings, provided by way of indication and therefore not by way of limitation, in which:

FIGS. 2 and 3A show an opening device placed outside the container;

FIG. 7 shows an opening device placed outside the container;

DEFINITIONS AND CONVENTIONS

Figure 1:
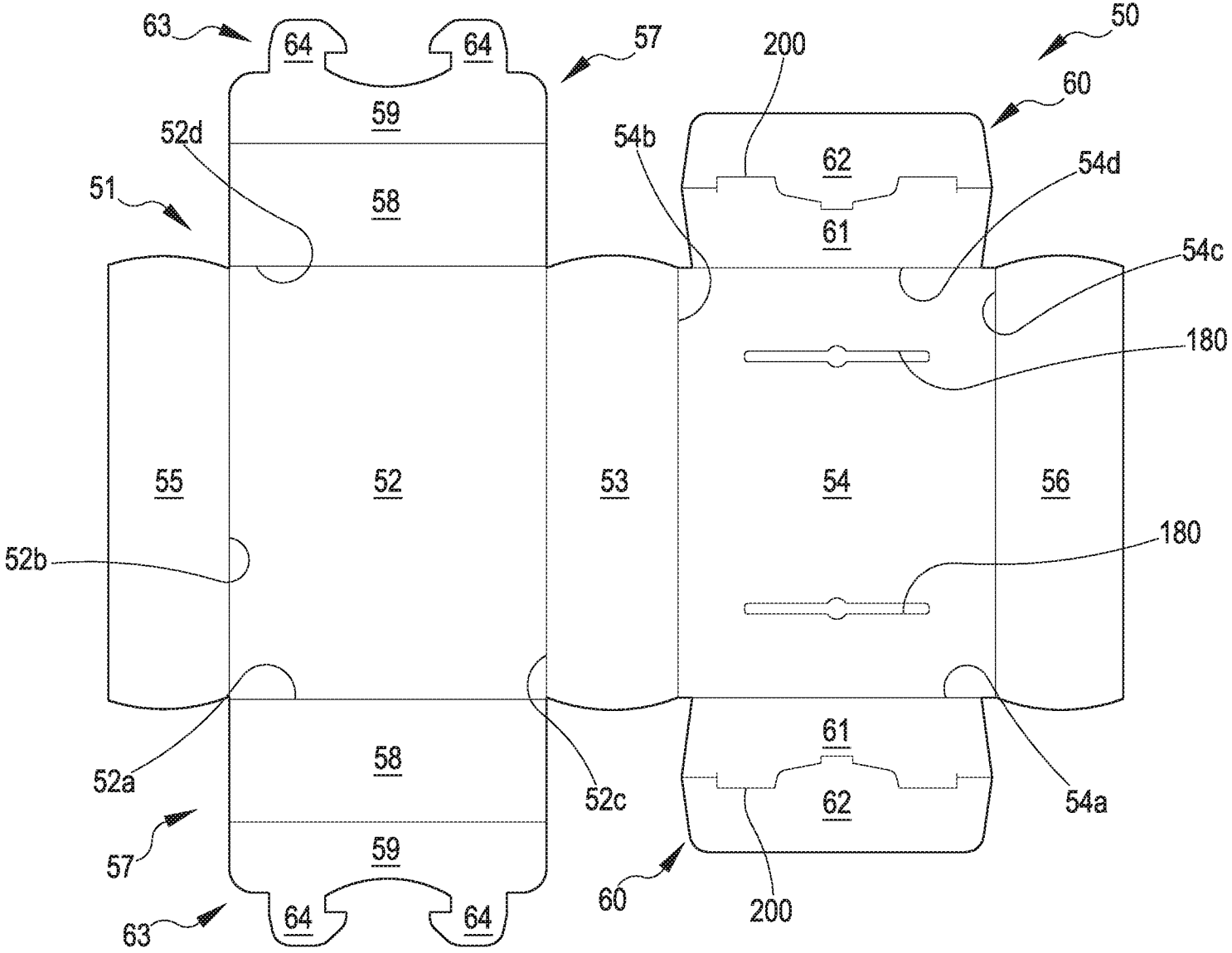
FIG. 1 shows a blank for the realization of a container according to a first embodiment.
Figure 2:
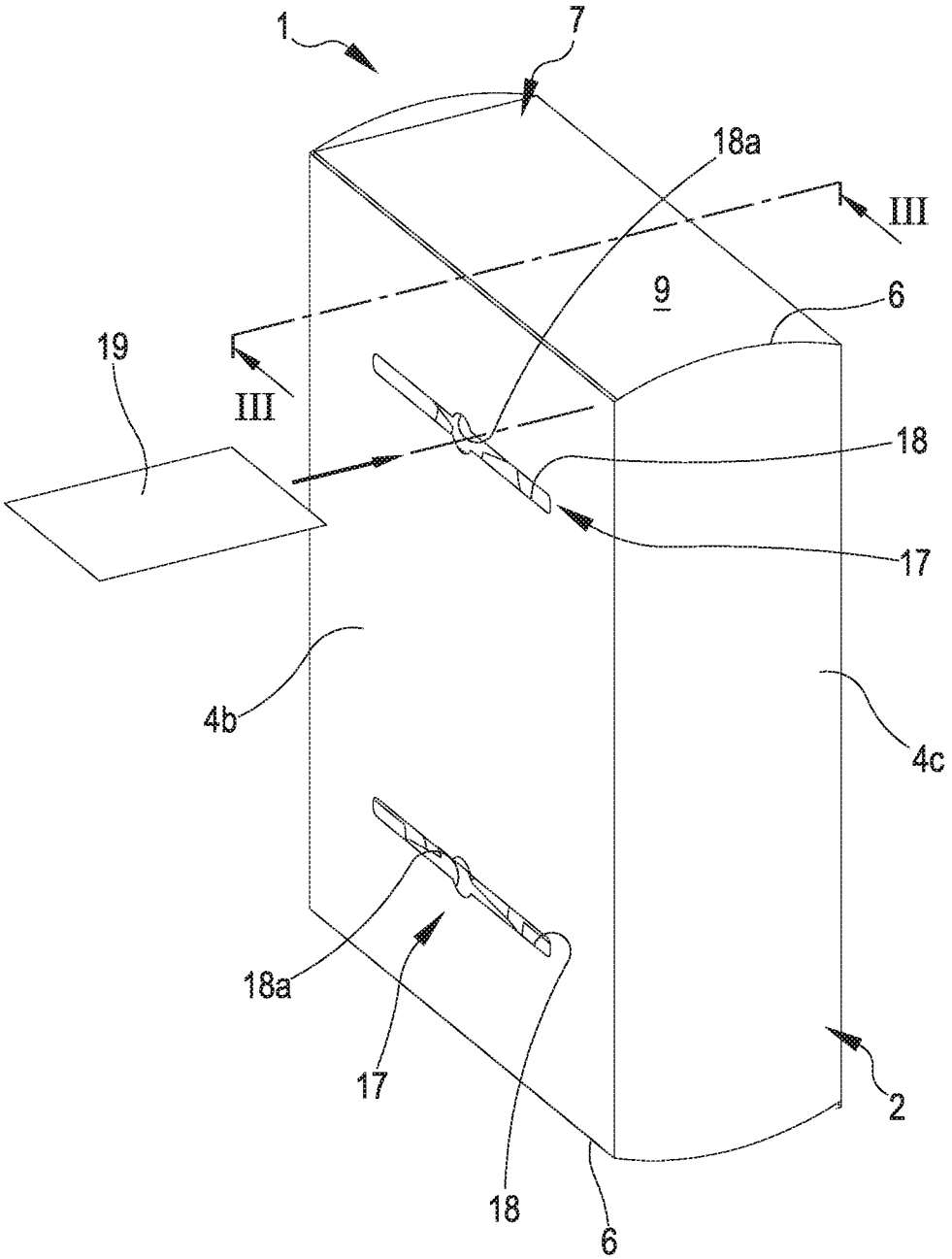
FIGS. 2 and 3A are perspective views of a container, according to the first embodiment, arranged in a closing condition.

It should be noted that in the present detailed description, corresponding parts shown in the various figures are indicated with the same reference numerals. The figures may show the object of the invention by means of not-to-scale representations; therefore, parts and components shown in the figures relating to the object of the invention may exclusively relate to schematic representations.

In the context of this description, the use of terms such as 'top', 'bottom', 'bottom', 'side', 'side', 'horizontal', 'vertical', 'front', 'front', 'front', 'rear', 'rear', 'rear' and the like refers, unless otherwise stated, to at least one condition of normal use/take of the container, namely a normal handling of the container by a user.

The term product means an article or a compound of articles of any kind. For example, the product may be a pharmaceutical or medicinal product in solid, liquid or gel form, or in the form of two or more of the aforementioned states of aggregation. The product can also be understood as a package, e.g. a blister, carrying a plurality of articles.

The term paper material means paper or cardboard, for example at least 50% by weight, optionally at least 70% by weight, of organic material comprising one or more cellulose, hemicellulose, lignin, lignin derivatives. The paper material may be in sheet material with a weight between 100 and 500 g/m$^2$. The paper sheet material may be covered at least partially by a plastic coating, for example a film, the purpose of which is to: reinforce the paper sheet material, define a barrier to water and/or moisture. The coating can be between 10 and 50 μm thick and made of one or more of the following materials: LDPE, HDPE, PP, PE.

With reference to the present invention, the term blank refers to a flat semi-finished product made of sheet material, e.g. paper sheet material, which can be folded on itself to make a container. The blank can be in a single piece and may be obtained by die-cutting a single sheet.

With the expression folded blank configuration means a configuration in which the blank is folded to form the container.

The term sheet material means a material with two dimensions, for example length and width, which are significantly larger than a third dimension such as thickness.

DETAILED DESCRIPTION

Container

A childproof container is indicated with 1. The container 1 comprises a store 2 defining an internal volume 3 configured to house one or more products. The store 2 represents the compartment of container 1 configured to house one or more products. The store 2 comprises a fixed number of side walls. The store 2 can have a parallelepiped shape, for example it may have, as shown in the enclosed figures, a substantially rectangular parallelepiped shape laterally defined by a first side wall 4*a*, a second side wall 4*b* opposed to the first side wall 4*a*, a third side wall 4*c* arranged between the first and second side walls 4*a*, 4*b* and a fourth side wall 4*d* opposed to the third side wall 4*c* and also arranged between the first and second side walls 4*a*, 4*b*. Alternatively, the store 2 may comprise a different number of walls from four. The side walls 4*a*, 4*b*, 4*c*, 4*d* define at least a passage opening 5 delimited by a free edge 6. The passage opening 5 is configured to connect the internal volume 3 of the store 2 with the external environment. The store 2 may have two passage openings 5 respectively defined at opposite longitudinal ends of the store 2. Each passage opening 5 is delimited by a respective free edge 6: the passage openings 5 are opposed to each other with respect to the store 2 in such a way that the latter essentially defines a conduit or pipe laterally delimited by the side walls 4*a*, 4*b*, 4*c*, 4*d* and open at opposite longitudinal ends. However, it is not excluded the possibility of realizing, for example, a storage 2 having a single passage opening 5 or more than two passage openings 5.

Figure 5:
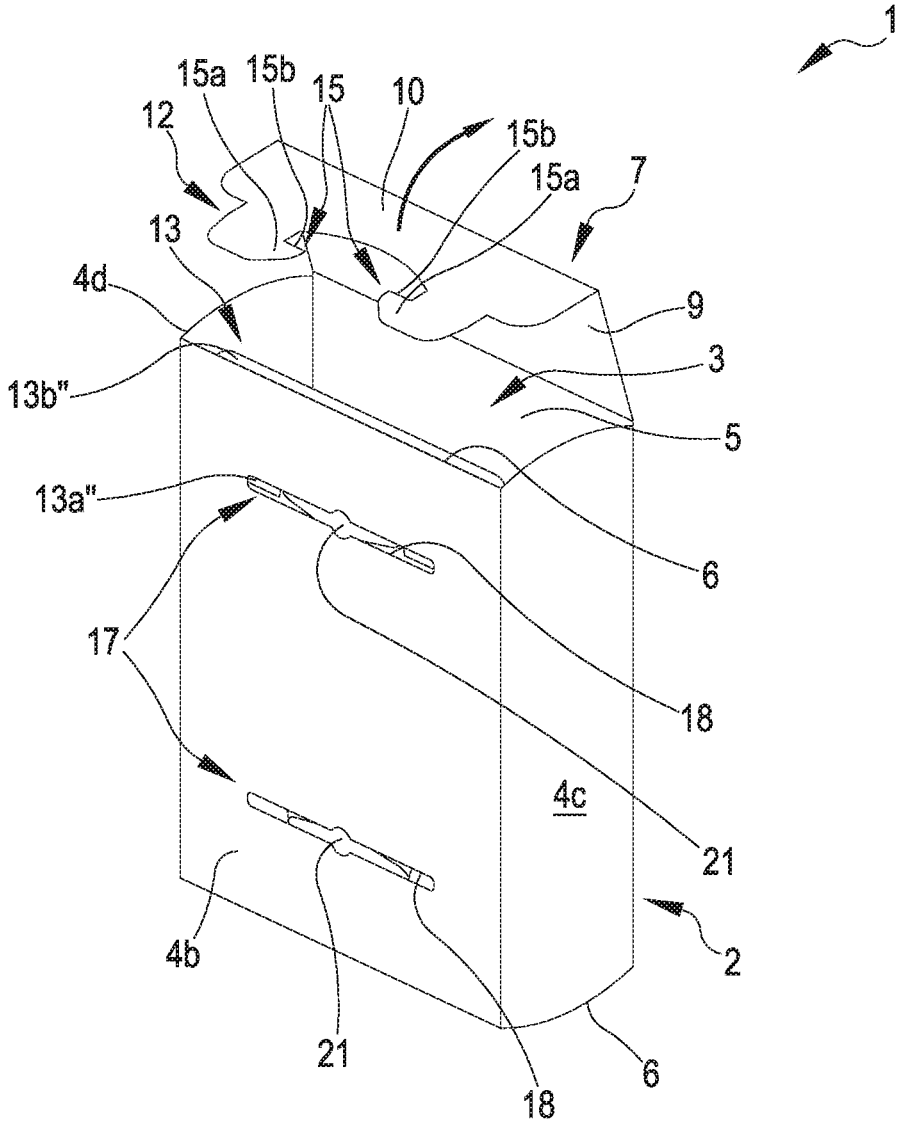
FIG. 5 shows the container in FIG. 2 in an opening condition.

The container 1 also comprises at least a closure system 7 engaged at free edge 6 and mobile in relation to store 2. The closure system 7 is configured to define at least a closing condition (see e.g. FIGS. 2, 4, 7, 10 and 11) in which the closure system 7 interdicts communication between the internal volume 3 of store 2 and the external environment and at least one opening condition (see e.g. FIG. 5) in which the closure system 7 allows communication between the internal volume 3 and the external environment. From a functional point of view, the closure system 7 essentially represents a lid act to cooperate with the store 2 in order to manage access to the internal volume 3. The container 1 may include a closure system 7 for each passage opening 5 of the store 2. The attached figures show, by way of example, a configuration of container 1 having two passage openings 5; in said embodiments, the container 1 has two closure systems 7 engaged at respective longitudinally opposed free edges 6 of the store 2. The closure systems 7 are therefore arranged in opposition to each other with respect to store 2 itself. Each closure system 7 may be joined in one piece with the store 2. In the attached figures, each closure system 7 is joined together with the free edge 6 and is movable by rotation around itself at least between closing and opening conditions.

In more detail, the closure system 7 comprises a closure portion 9 made of sheet material directly engaged and joined to the free edge 6 of store 2. The closure portion 9 is configured to prohibit access to the internal volume 3 of the store 2 in the closing condition of closure system 7. The closure portion 9 has a rectangular shape entirely counter-shaped to the free edge 6. Further conformations of the closure portion 9 and of the free edge 6 may be provided, act to allow the closure portion 9 to occlude the respective passage opening 5 in the closing condition of the closure system 7. The closure system also comprises an inserting portion 10 configured to fit, in the closing condition of the closure system 7, into the internal volume 3 of the store 2. The inserting portion 10 is joined in one piece to the closure portion 9 and emerges from the latter on the opposite side to the free edge 6. The inserting portion 10 extends from the closure portion 9: in the closing condition of the closure system 7, the inserting portion 10 is positioned completely in the internal volume 3 of the store 2. The inserting portion 10 also comprises a flat sheet with a substantially rectangular shape. It is understood that further shapes may be provided for the inserting portion 10, e.g. a square or trapezoidal shape.

Figure 3A:
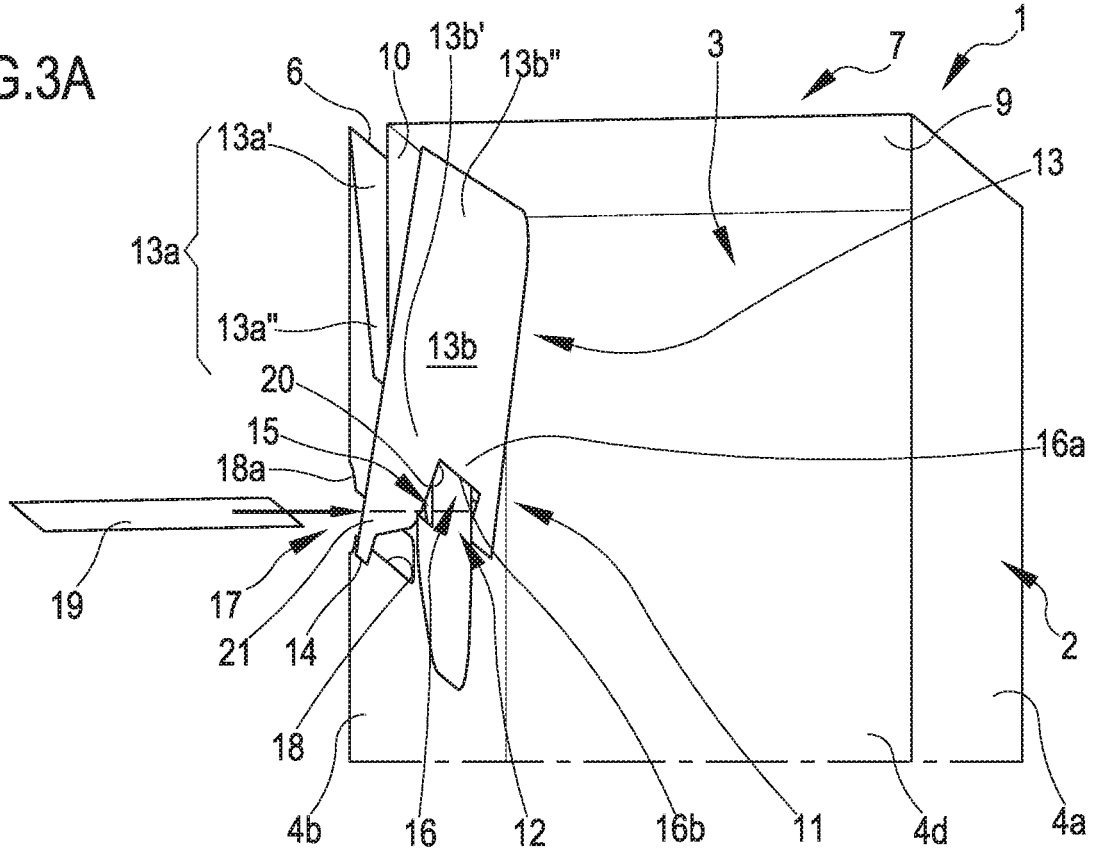

The closure portion 9 and the inserting portion 10 have a mutual connecting edge opposite the free edge 6 of the store 2 with respect to the closure portion 9 itself. The inserting portion 10 is movable by rotation with respect to the closure section 9 around said mutual connecting edge. The inserting portion 10, in the closing condition of the closure system 7, is configured to define, according to a transversal cross-section and in cooperation with the closure portion 9, a substantially "L" shape (see for example FIG. 3A, FIG. 8 and FIG. 10). In detail, as may be seen for example from FIGS. 3A, 3B, 5, 7, 8, 10, the closure system 7 is directly constrained to the first side wall 4*a*; the inserting portion 10, in the closing condition of the closure system 7, extends substantially parallel to the second side wall 4*b* of the store 2. As may be seen from the enclosed figures, the first side wall 4*a* of the store 2, to which the closure system 7 is linked, essentially defines a rear wall of the store 2 while the second side wall 4*b* defines a front wall of store 2.

The container 1 also includes at least a safety device 11 having at least a first coupling portion 12 carried by the closure system 7 and at least a second coupling portion 13 engaged to the store 2. The first and second coupling portions 12, 13 are configured to stably engage each other during a closing condition of the closure system 7 (see for example FIGS. 3A, 4, 8 and 10). In the closing condition of the closure system 7, the safety device 11, and consequently the container 1, assumes a locking condition in which the opening of the container 1 is prevented by the engagement between the first and second coupling portions 12, 13.

In detail, in the closing condition of the closure system 7, the first coupling portion 12 is configured to fit at least partially into the internal volume 3 of store 2 to stably engage the second coupling portion 13. As shown for example in FIG. 3A, in the closed condition of the closure system 7, the first coupling portion 12 is entirely contained in the internal volume 3 of store 2 and it is distanced from the free edge 6 of the store 2. In the closing condition of the closure system 7, the engagement between the second coupling portion 13 and the first coupling portion 12 is completely defined in the internal volume 3 of the store 2 (see FIGS. 3A, 4, 8 and 10). The engagement between the first and second coupling portions 12, 13 is of reversible type; in other words, following the opening condition of the closure system 7 has been reached, the first and second coupling portions 12, 13 may be engaged again to define again the closing condition of the closure system 7 and consequently a new locking condition of the safety device 11. This is possible because, when switching between the closing and the opening condition, the first coupling portion 12 is simply disengaged from the second coupling portion 13. In other words, when passing between the closing condition and the opening condition, the first and second coupling portions 12, 13 are not removed or detached respectively from the closure system 7 and from the store 2 but remain engaged to the latter. In this way, since there are no removable portions of the safety device 11, the first and second coupling portions 12, 13 are configured to reversibly define, following each opening condition of the closure system 7, a locking condition in which said portions 12, 13 are stably engaged with each other.

In detail, the second coupling portion 13 comprises a first panel 13*a* and a second panel 13*b* engaged together. The first panel 13*a* has a first end 13*a*' and a second end 13*a*" opposed to each other with respect to a central portion of the first panel 13*a*; the first end 13*a*' is engaged, optionally joined in one piece, to the free edge 6 and emerges from the second side wall 4*b* (front wall of the store), while the second end 13*a*" is engaged to the second panel 13*b* on the opposite side to the free edge 6. The first panel 13*a* may be fixed to the second side wall 4*b*, e.g. by gluing and the second panel 13*b* maybe moved with respect to the first panel 13*a*. The second panel 13*b* has a first end 13*b*' and a second end 13*b*" opposite each other with respect to a central portion of the second panel 13*b*; the first end 13*b*' of the second panel 13*b* is engaged at the second end 13*a*" of the first panel 13*a* and the second end 13*b*" of the second panel 13*b* is movable with respect to the first panel 13*a* and therefore with respect to the second side wall 4*b*. The first and second panels 13*a*, 13*b* share, at the second end 13*a*" of the first panel 13*a* and the first end 13*b*' of the second panel 13*b*, a folding edge 14. The first and second panels 13*a*, 13*b* are relatively movable to each other by rotation around the folding edge 14.

In detail, the first and second panels of the second coupling portion 13 are folded together to define a substantially "V" shape in which two internal surfaces of the folded portion (surfaces delimiting the concavity of the V shape of the folded portion) face each other; the external surface of the first panel 13*a* is facing, and at least partly in contact, with the second lateral wall 4*b* (front wall) of the store 2 while the external surface of the second panel 13*b* (defining said folded portion) is facing towards the first lateral wall 4*a* (rear lateral wall) of the store. The first and the second panels of the second coupling portion 13 are normally angularly offset with each other—as maybe seen from the enclosed figures at an acute angle—to define said folded portion. The second panel 13*b* may rotate relatively with respect to the first panel 13*a* so as to vary the angular offset of said panels 13*a*, 13*b*: the movement of said panels therefore determines the shape of the "V" of the folded portion.

As may be seen from the attached figures, the second coupling portion 13 is located inside the store 2: the second coupling portion 13 completely develops in the internal volume 3 both in the closing condition and in the opening condition of the closure system 7. The second coupling portion 13 is engaged in the second side wall 4*b* of store 2, which is directly facing, in the closing condition of the closure system 7, the inserting portion 10.

The second coupling portion 13 comprises at least a through opening 20 configured to receive in insertion at least part of the first coupling portion 12 in order to allow the engagement with the second coupling portion 13.

In an embodiment, the through opening 20 is defined at the folding edge 14 of the first and second panels 13*a*, 13*b*; in detail, each through opening 20 is defined partly at the folding edge 14 and partly extends over at least one between said first and second panels 13*a*, 13*b*. As shown, for example, in FIGS. 3A to 4A, the through opening 20 (in particular each through opening) extends at least partially over the second panel 13*b*. The free edge of the through opening 20 delimits an undercut 16 inside store 2, spaced from the free edge 6. The undercut 16 defines a hook 16*a* delimiting a seat 16*b* with a substantially 'C' or 'U' shape. The seat 16*b* is configured to allow, during the transition from the opening to the closing condition, the insertion of the first coupling portion 12 for the stable engagement of the latter to the undercut 16 (at the hook 16*a*) of the second coupling portion 13. In the embodiment shown in FIG. 8, the through opening 20 extends partly to the first panel 13*a* and partly to the second panel 13*b*. In detail, in this configuration, the first and second panels 13*a*, 13*b* of the second coupling portion 13 are movable relatively to each other at least between:

- a locking position in which the first and second panels are angularly offset from each other and configured to prevent the first coupling portion, in the locking condition, from coming out of the through opening 20 of the second coupling portion 13 thus preventing the disengagement between the first and second coupling portions,
- a release position in which the first and second panel 13*a*, 13*b* are, at least in part, substantially parallel to each other and configured to allow the release of the first coupling portion 12 from the through opening 20 of the second coupling portion 13 thus allowing the disengagement between the first and second coupling portion and the passage of the closure system from the closing condition to the open one.

Figure 10:
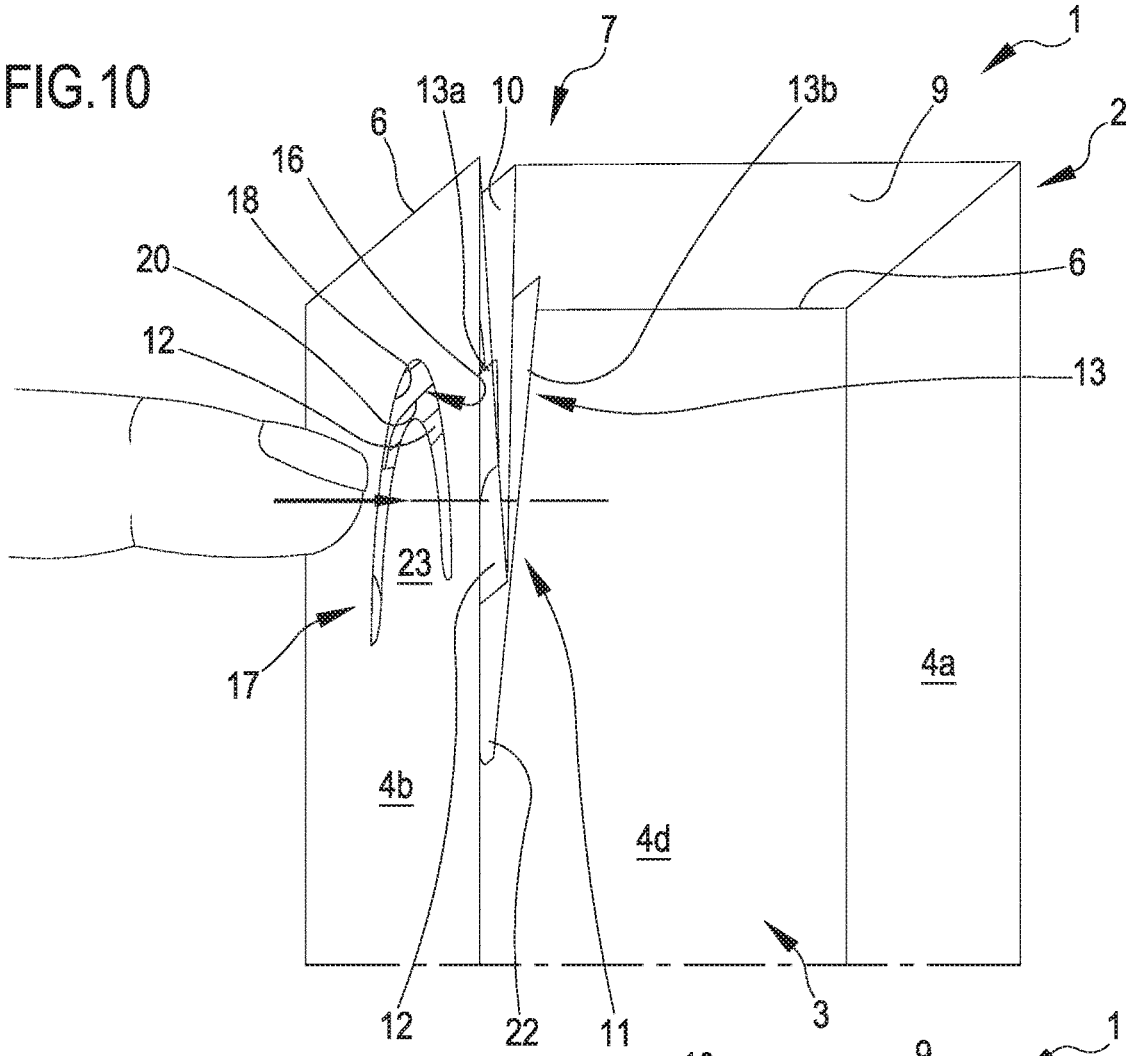
FIG. 10 is a sectional view of a container according to a third embodiment.
Figure 10A:
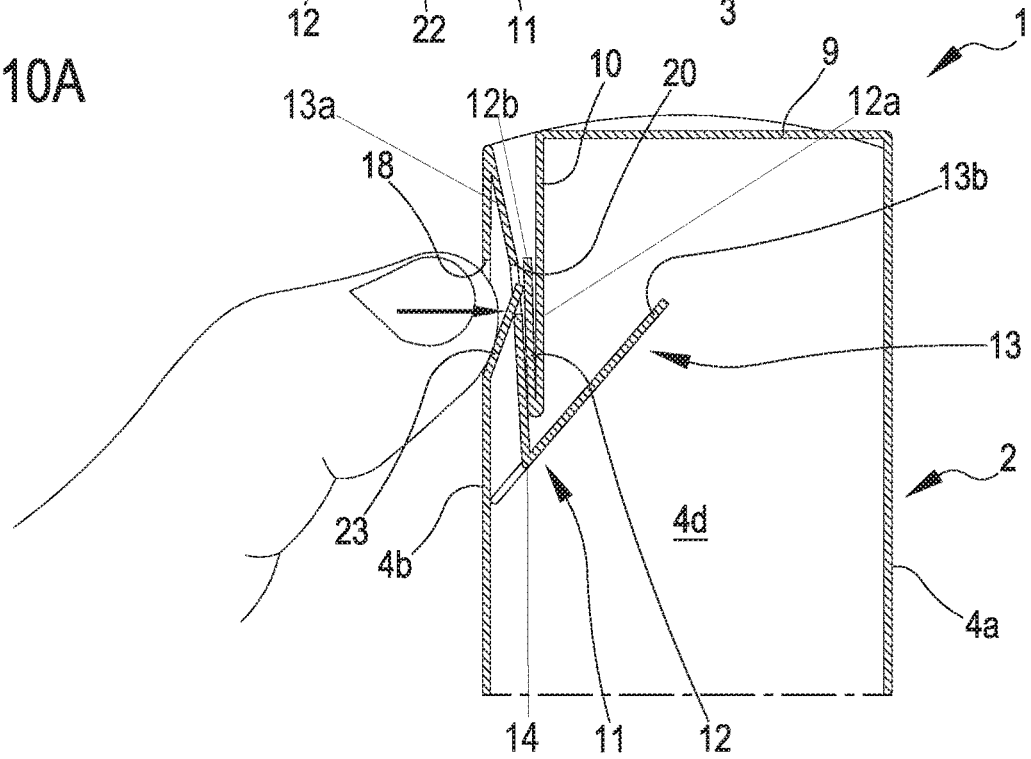
FIG. 10A is a section of the container of FIG. 10 made along a centre line of the container; the safety device of the container being in a releasing phase by the manual action of a user.
Figure 10B:
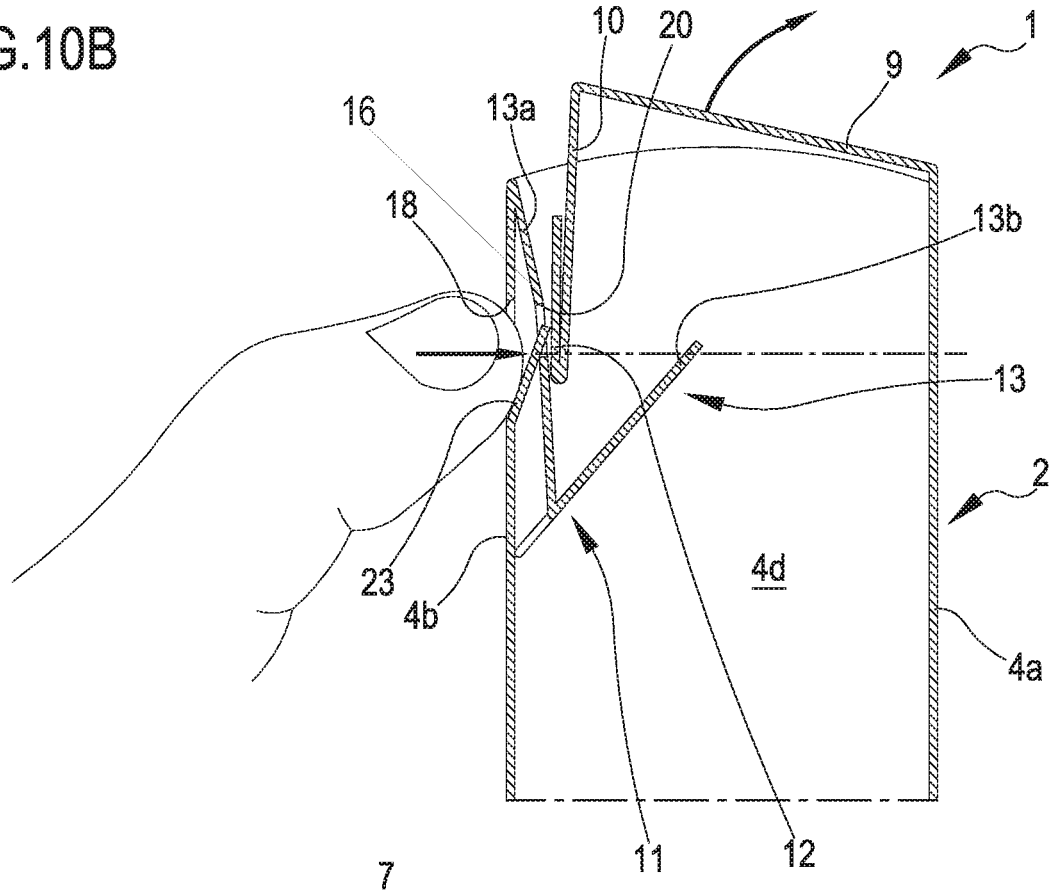
FIG. 10B shows a phase of an opening method the container according to the third embodiment, in which the closure system is moved by rotation, starting from the configuration shown in FIG. 10A, so as to determine the opening of the container.
Figure 11:
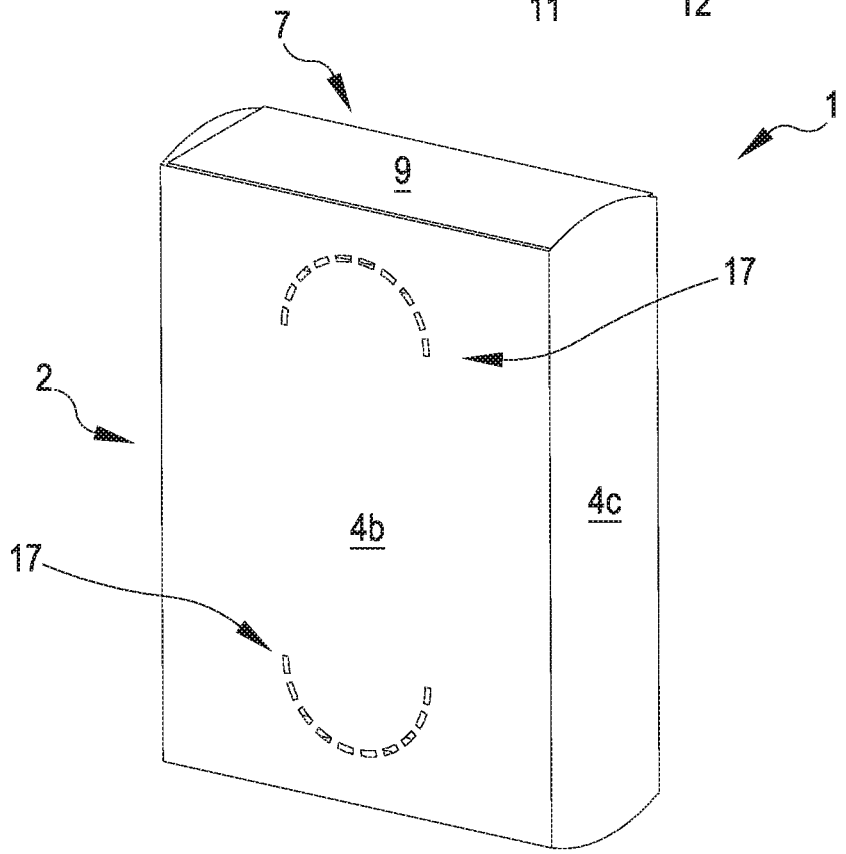
FIG. 11 is a perspective view of a container according to a fourth embodiment.

Alternatively, as illustrated in FIGS. 10A and 10B, the through opening 20 may be defined entirely and exclusively on the first panel 13*a*. In this configuration, through opening 20 is delimited by a closed profile spaced from the free edge 6 of store 2 and the folding edge 14. Also in this configuration, the through opening 20 defines an undercut 16 which in turn defines a hook 16*a* configured to stably engage the first coupling portion 12 in the closed condition of the closure system 7. Also in this configuration, the hook 16*a* delimits a seat 16*b* having a "C" or "U" shape. The seat 16*b* shall be configured to allow, during the transition from opening to closing condition, the insertion of at least part of the first coupling portion 12 for the stable engagement of the latter to the undercut 16 (at hook 16*a*) of the second coupling portion 13.

Figure 3B:
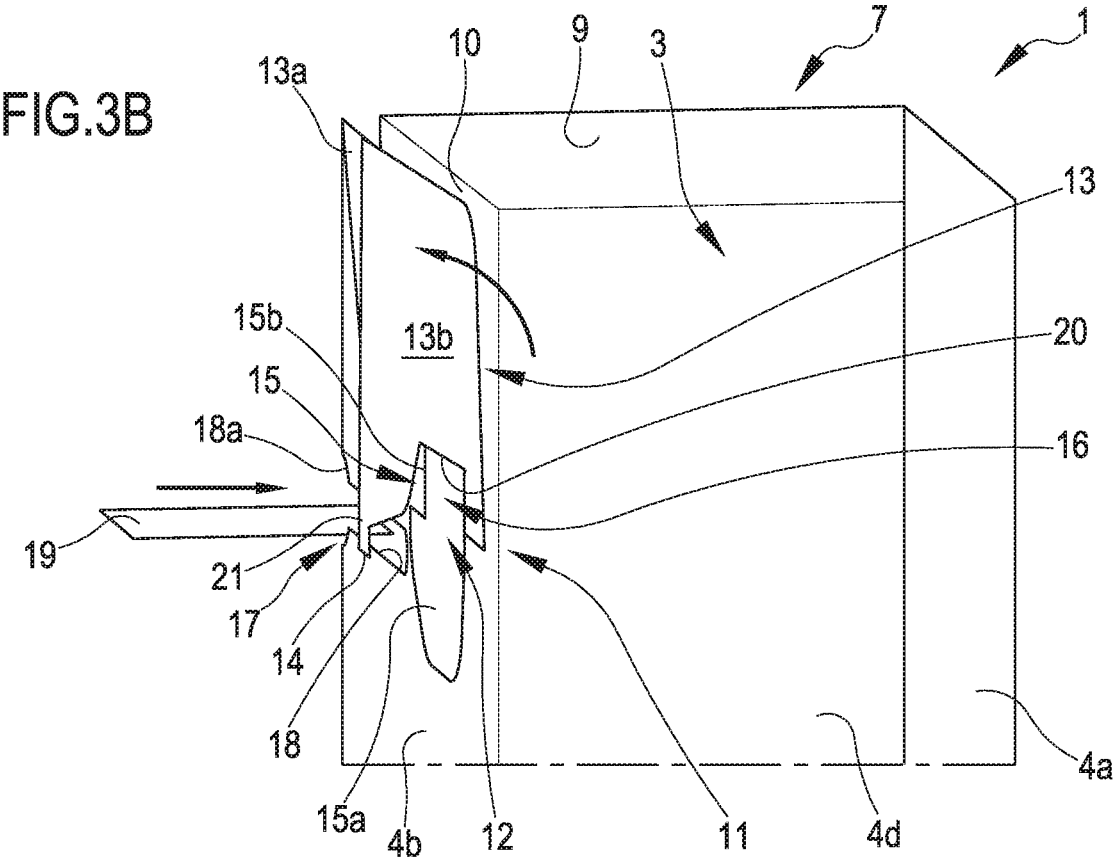
FIG. 3B shows the container in FIG. 3A in an intermediate step between the closing and the opening condition of the container, wherein the opening device operates on a safety device of the container to unlock it.

The second coupling portion 13 may also include an unlocking appendix 21 defined at the first end 13*b*' of the second panel 13*b* of the second coupling portion 13. As shown in FIG. 3B, the unlocking appendix 21 is carried by the second panel 13*b* and is configured to rotate the second panel 13*b* with respect to the first panel 13*a* from the locking position to the release position, and vice versa. The unlocking appendix 21 may be in one piece with the second panel 13*b*. The first coupling portion 12 is carried by the closure system 7. In detail, the first coupling portion 12 is carried by the inserting portion 10. The first coupling portion 12 and the inserting portion 10 may be joined in one piece to form a single body. The first coupling portion 12 comprises a flat sheet body which emerges seamlessly from the inserting portion 10, opposed to the closure portion 9. The inserting portion 10 is then interposed between the closure portion 9 and the first coupling portion 12.

The first coupling portion 12 comprises at least an undercut 15 configured to stably engage the second coupling portion 13 arranged inside store 2 in the closing condition of closure system 7. The undercut 15, in the closing condition of closure system 7, is distinct and distanced from the free edge 6 of the store 2.

In an embodiment illustrated for example in FIGS. 3A-5, the undercut 15 comprises at least a hook 15*a* extending in extension of the inserting portion 10 of the closure system 7: hook 15*a* is opposite the closure portion 9 with respect to the inserting portion 10. Each hook 15*a* define a seat 15*b*. As illustrated for example in FIGS. 4 and 5, the first coupling portion 12 may comprise two hooks 15*a* having respective seats 15*b* having concavities facing each other. The hook 15*a* of the first coupling portion 12 is configured to fit, in the closing condition of the closure system 7, inside the through opening 20 defined at the folding edge 14 (second coupling portion 13 shown in FIGS. 3A to 4A) such that it stably engages the hook 16*a* of the second coupling portion 13. If there are several hooks 15*a*, each of them is configured to engage either a single hook 16*a* or to respective hooks 16*a* of the second coupling portion 13. Alternatively, the first coupling portion 12 comprises a folded portion essentially in a "V" shape whose concavity is directed, in the closing condition of closure system 7, towards the outside of the container 1. In fact, the folded portion of the first coupling portion 12 is defined by two sheet panels joined together in one piece at an end portion to define this profile having essentially a "V" shape. The folded portion of the first coupling portion 12 is configured to fit at least partially and engage in a through opening 20 defined exclusively on the first panel 13*a* (configuration of the second coupling portion illustrated in FIGS. 10A and 10B) of the second coupling portion 13.

In detail, the folded portion of the first coupling portion 12 is defined by a first and a second panel 12*a*, 12*b* folded to define said "V" profile (see for example FIG. 10A) whose concavity, in the closing condition of the closure system, is facing the outside of container 1. In this embodiment, the undercut 15 of the first coupling portion 12 is defined by the second panel 12*b* act to fit at least partially, in the closing condition of the closure system, into the through opening 20 defined exclusively on the first panel 13*a* of the second coupling portion 13. In fact, in this configuration, the second panel 12*b* of the first coupling portion 12 defines the hook 12*a* configured to stably engage the undercut 16 of the second coupling portion 13.

In the locking condition of safety device 11, the "V" folded portion of the first coupling portion 12 is housed in the concavity of the "V" folded portion of the second coupling portion: in this configuration, the concavities of the folded portions of the first and second coupling portions are both facing outwards from container 1.

The container 1 also comprises at least one unlocking portion 17. The unlocking portion 17 is defined at a side wall 4*a*, 4*b*, 4*c*, 4*d* of the store. In detail, the unlocking portion 17 is defined at the first side wall 4*a* or the second side wall 4*b*. The unlocking portion 17 is configured to allow, in the locking condition of the safety device, the disengagement of the first and second coupling portion and therefore the passage of the closure system 7 from the closing condition to the open condition. The unlocking portion 17 is configured to define at least one through access 18. The through access 18 allows access to the internal volume 3 of the store 2 to allow a user to act on the safety device 11 to allow the disengagement of the first and second coupling portions and thus the passage of the closure system 7 from the closing to the opening condition. The through access 18 may be separated from the free edge 6.

In detail, the through access 18 may be configured to allow, in the locking condition of the safety device 11, the insertion of an opening device 19 in the internal volume 3 of the store 2 or a manual intervention by the user directly on at least one between the first and the second coupling portions 12, 13. In order to allow access to the safety device 11 to operate on it, the through access 18 is arranged on a side wall 4*a*, 4*b*, 4*c*, 4*d* of store 2 such that it is substantially facing the safety device 11.

The through access 18 may be defined at one longitudinal end of the side wall 4*a*, 4*b*, 4*c*, 4*d* of store 2 at which it develops. The longitudinal ends of the side walls 4*a*, 4*b*, 4*c*, 4*d* of the store 2 are defined near a respective free edge 6 of the store 2. In the embodiments described in the following, the through access 18 is defined at the same longitudinal end of the store 2 at which, in the closing condition of closure system 7, the first coupling portion 12 and the second coupling portion 13 also develop. Thus, in the closing condition of closure system 7, the through access 18 is defined substantially at the safety device 11.

Figure 4:
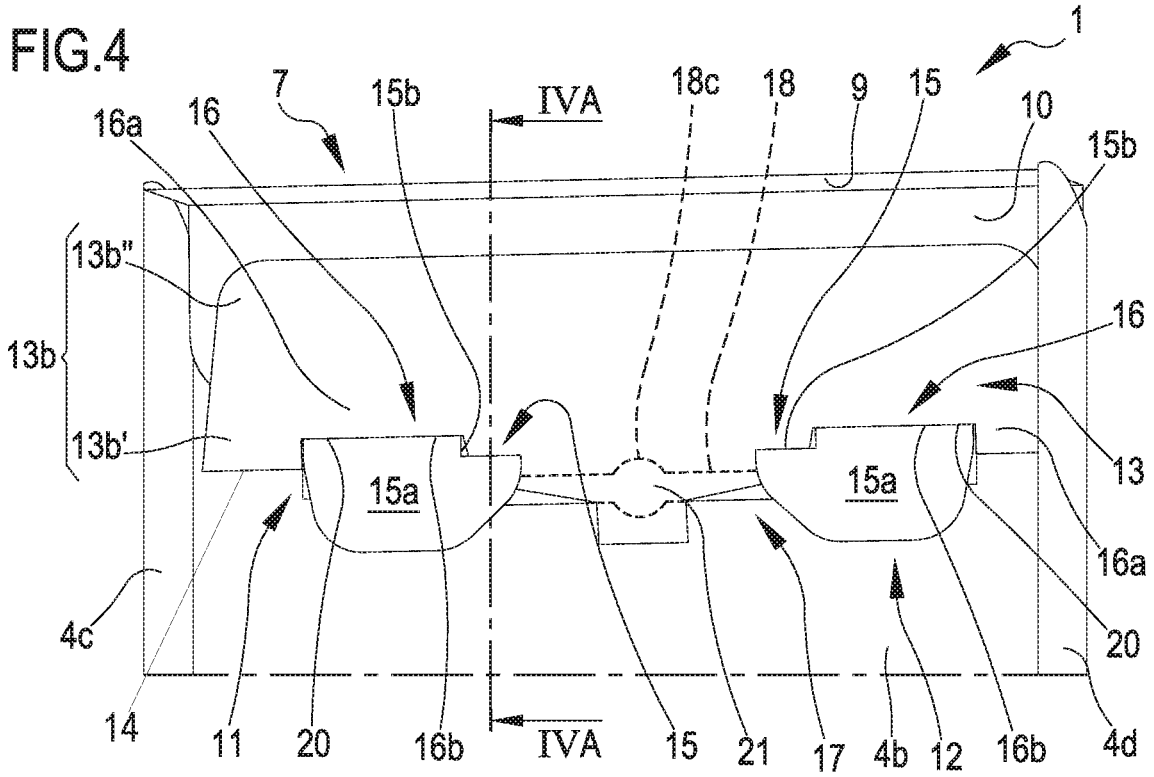
FIG. 4 is a rear view of a cutaway view of the container in FIG. 2, wherein the safety device is in a locking condition.
Figure 4A:
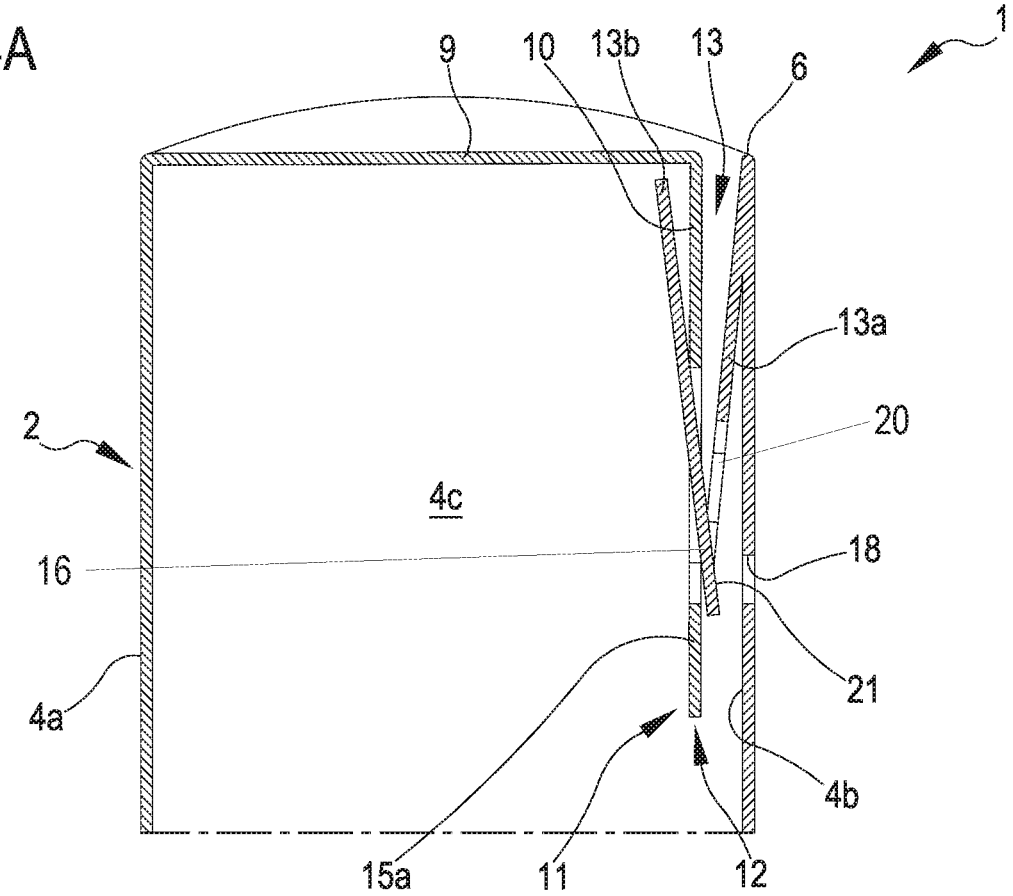
FIG. 4A is a section of the container in FIG. 4, according to the IVA-IVA track.

In the embodiment shown for example in FIG. 4A, the through access 18 is defined on the front wall 4*b* of the store 2, directly facing the second coupling portion 13. In detail, in this configuration, the through access 18 is directly facing the first panel 13*a* of the second coupling portion and the appendix 21. In this configuration, the through access 18 allows a user to manually intervene or by means of a special opening device 19 on the first and/or second coupling portion to disengage it. In particular, in the embodiment illustrated in FIG. 4A, through access 18 is configured to allow the relative rotation of the first and second panel 13*a*, 13*b* of the second coupling portion 13 to allow the passage of said panels 13*a*, 13*b* from the locking position to the release position so that hook 15*a* of the first coupling portion 12 may free itself from hook 16*a* of the second coupling portion and escape from the through opening 20. Thanks to the rotation of the panels 13*a*, 13*b* it is therefore possible to disengage the first coupling portion 12 from the second coupling portion 13 allowing the passage of the closure system 7 from the closing to the opening condition. The movement of the panels 13, 13*b* may be generated manually from the outside by a user (e.g. by inserting a finger through the through access) or by an opening device 19. In detail, the relative rotation of the panels 13*a*, 13*b* may be generated by direct push on the unlocking appendix 21 which, as described above, is joined in one piece to the second panel 13*b* of the second coupling portion 13. The through access 18 may be arranged on the front wall 4*b* facing the appendix 21.

The unlocking portion 17 may include a thrust portion 23 arranged near the through access 18 or within a cavity defined by the through access 18. The thrust portion 23 directly defines a part of the external side wall of the store 2 itself being movable between:

- a thrust condition, in which the thrust portion acts on the safety device allowing the disengagement between the first and second coupling portion, and
- a rest condition, in which the thrust portion is distanced from the safety device.

The thrust portion may be pressed manually by the user so that the same thrust portion 23 may act on appendix 21 or on one of said panels 13*a*, 13*b* to allow rotation from the locking position to the release one.

The through access 18 may always be defined on the front wall 4*b* of the store and allow access to the store to act in thrust directly on the first coupling portion 12 as shown in FIGS. 10 to 10B; in such embodiment, the through access 18 allows a user to act in thrust on the second panel 12*b* of the first coupling portion 12 to allow the release of said second panel 12*b* (defining the undercut 15 of the first coupling portion 12) from the through opening 20 defined on the first panel 13*a* of the second coupling portion and then to free the undercuts 15, 16 of the respective coupling portions 12, 13.

The thrust on the second panel may be done manually by a user as shown in FIGS. 10A and 10B or it may be done by an opening device 19.

The thrust on the second panel 12*b* of the first coupling portion 12 may be performed by the user manually by means of the thrust portion 23 as schematically shown in FIGS. 10 to 10B. In the thrust condition, the thrust portion 23 contacts the first coupling portion 12 and allows its disengagement from the second coupling portion 13: the thrust portion 23 may functionally act as a button. With reference to FIG. 10, which illustrates the locking condition of the safety device 11, the thrust of a user's finger on the thrust portion 23 allows the thrust portion 23 to contact the first coupling portion 12 and disengage it from the undercut 16 of the second coupling portion 13. In this way, the closure portion 9 may be moved by rotation with respect to the free edge 6 to which it is engaged allowing the opening of the container 1. By crossing the through access 18, the user's finger essentially acts as an opening device. The thrust portion 23 may be reversibly moved between the thrust condition and the rest condition.

The container 1 may include an opening device 19 configured to allow the passage of the closure system 7 from the closing condition, corresponding to the locking condition of the safety device 11, to the opening condition. The opening device 19 may be made of paper sheet material; however, the opening device may be made of other materials, such as plastic foil or metal sheet material. The opening device 19 may be made of material with appropriate rigidity allowing it to operate in thrust on safety device 11. For this purpose, the opening device 19 may have a rigidity substantially equal to or greater than the rigidity of the first and second coupling portions 12, 13 of the safety device 11.

As shown in FIGS. 2, 3A, 3B, 7 and 8, the opening device 19 may be a card configured to be inserted through the through access 18. The card 19 has a substantially planar development and has a lower thickness, e.g. lower than one order of magnitude, than a length of the card 19 itself and lower than a width of the card 19. In one variant, the opening device 19 may be an elongated element, such as a pen or a stick.

The container may include a tearing portion arranged at the closing of the through access; said tearing portion is configured to be torn off during the condition of first opening of the container. In this way, the tearing portion is configured to give evidence of a first opening of the container and possibly an attempt of tampering the same. As an alternative to the tearing portion, the container may include one or more constraining elements configured to keep the push portion in the rest condition. These constraining elements (shown schematically in FIG. 11) are configured to break during a first push by the user on the thrust portion 23. These constraining elements are then also configured to give evidence of an initial opening of the container and possibly an attempt of tampering it.

Blank

Figure 6:
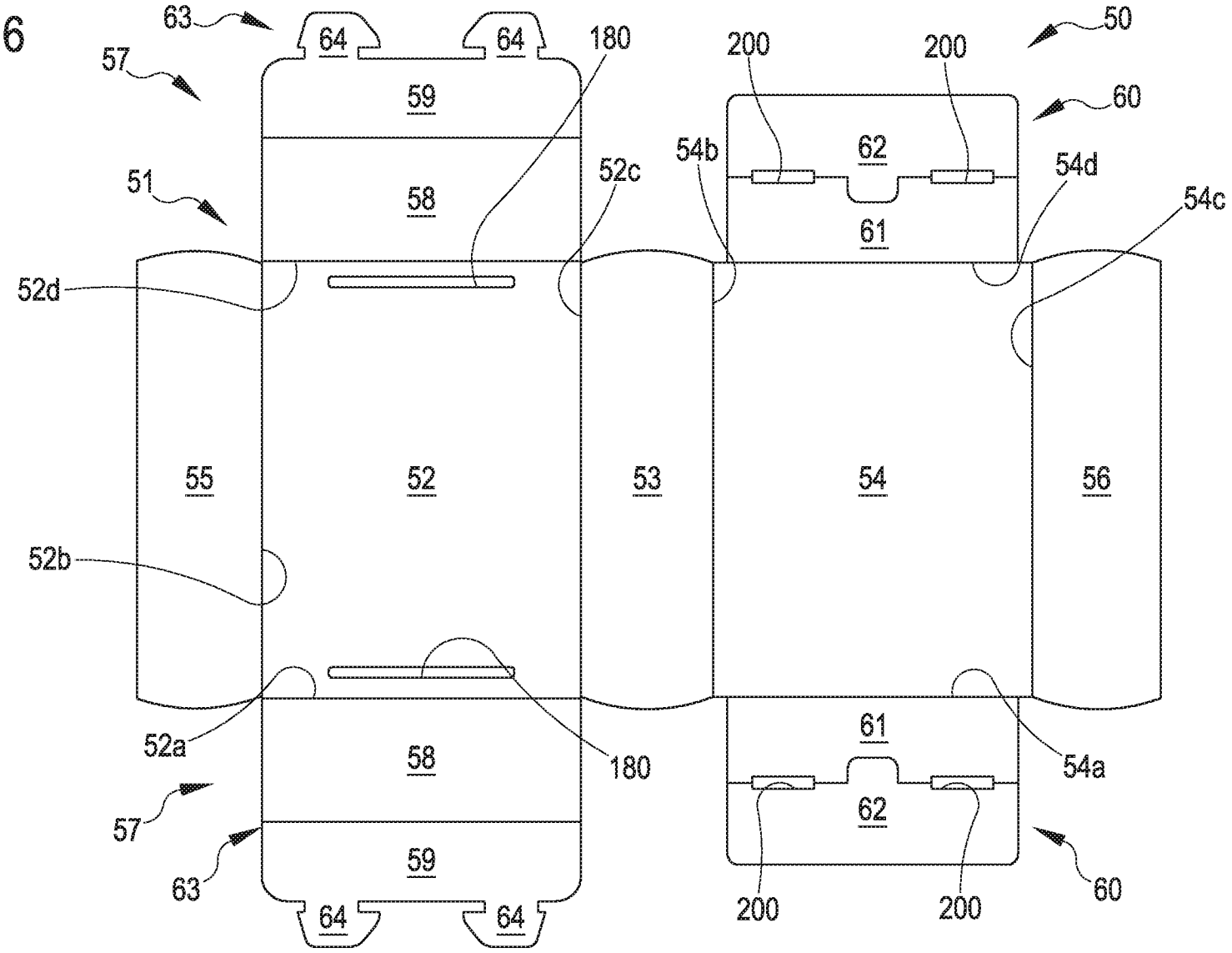
FIG. 6 shows a blank for the realization of a container according to a second embodiment.
Figure 7:
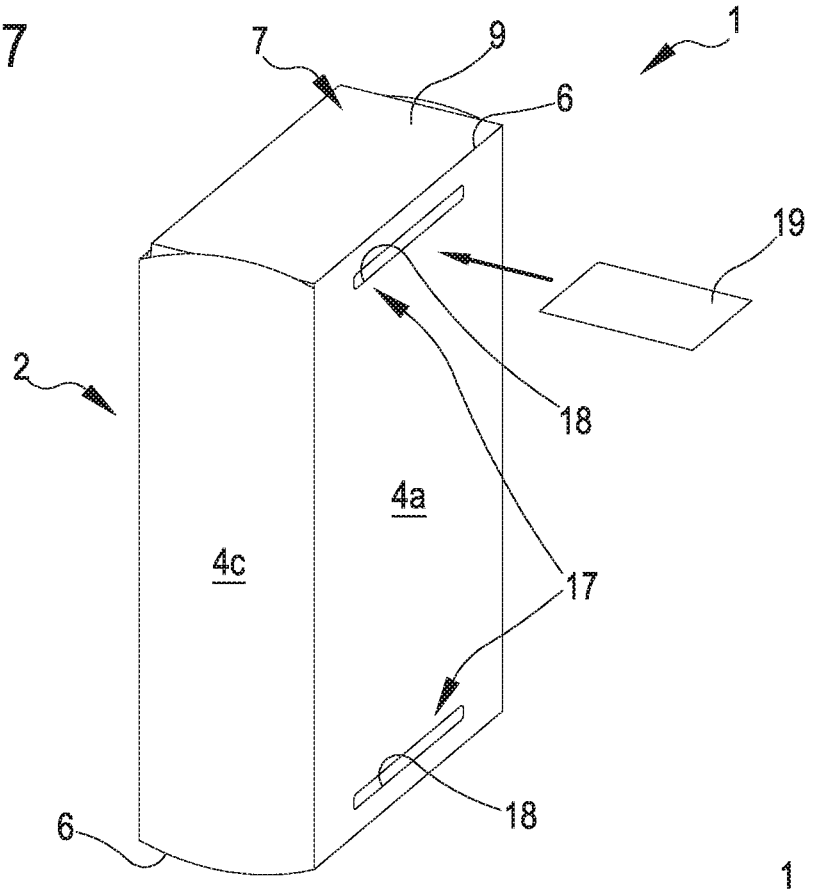
FIG. 7 is a perspective view of a container according to a second embodiment.
Figure 8:
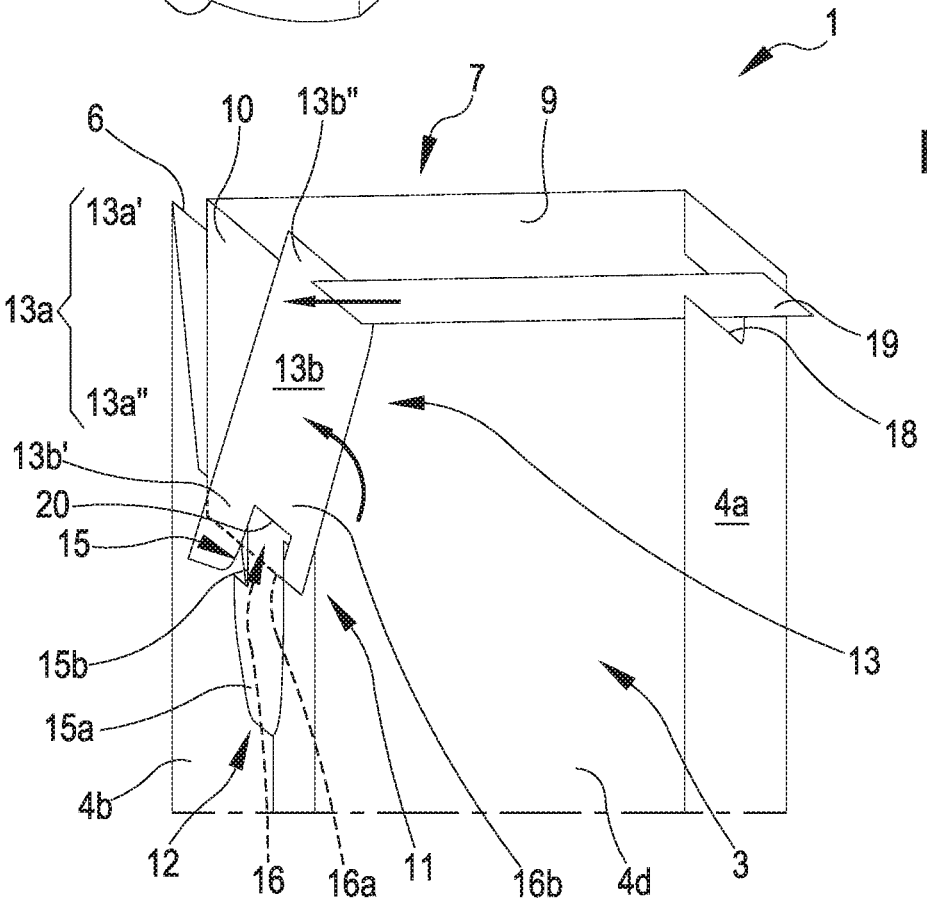
FIG. 8 is a section of the container in FIG. 7 wherein an opening device operates on the container's safety device to unlock it.
Figure 9:
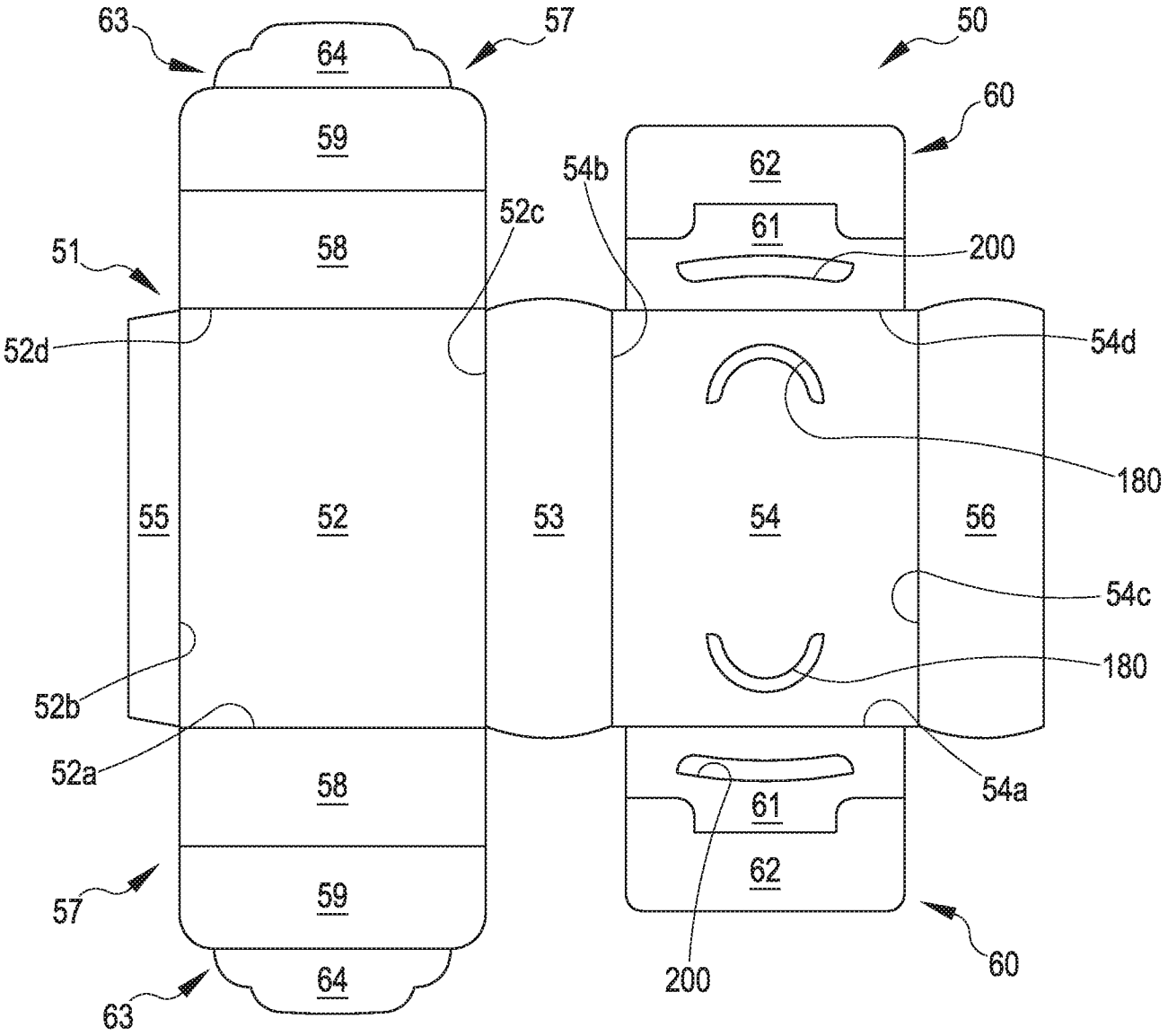
FIG. 9 shows a blank for the realization of a container according to a third embodiment.

The present invention also relates to a blank 50 in paper sheet material from which the container 1 may be made. FIG. 1 illustrates a blank according to the first embodiment, from which it is possible to make by folding the container shown in FIGS. 2-5. FIG. 6 shows a blank 50 according to a second embodiment, from which it is possible to make the container 1 in FIGS. 7,8 by folding. FIG. 9 shows a blank 50 according to a third embodiment, from which it is possible to realize by folding the container of FIG. 10. In the following the embodiments' common characteristics of the blank 50 and their main differences are described.

The blank comprises at least a first sheet 51 comprising at least a first and a second portion 52, 54 interconnected by a central connecting portion 53. The first sheet 51 also comprise at least a first and a second lateral connecting portion 55, 56. As shown for example in FIGS. 1, 6 and 9, the central connecting portion 53 is interposed between the first and second portions 52, 54, the first portion 52 is interposed between the first lateral connecting portion 55 and the central connecting portion 53 and the second portion 54 is interposed between the second lateral connecting portion 56 and the central connecting portion 53. Each of said portions 52, 53, 54, 55, 56 comprise at least two opposite longitudinal edges and two opposite external edges: the portions 52, 54, the central connecting portion 53 and the lateral connecting portion 55, 56 are joined along the longitudinal edges and aligned in a single connecting direction. The first portion 52 of the first sheet 51 has a rectangular shape perimetrically delimited by a lower edge 52*a*, a first and second side edge 52*b*, 52*c* and an upper edge 52*d*. Similarly, the second portion 54 of the first sheet 51 has a rectangular shape perimetrically delimited by a lower edge 54*a*, a first and second side edge 54*b*, 54*c* and an upper edge 54*d*. The first and second portions 52, 54 may comprise a sheet having substantially the same shape and size. The central portion 53 and the lateral connecting portions 55, 56 also have a rectangular shape; these portions have substantially the same shape and dimensions and are joined together in one piece to the portions 52 and 54 of the first sheet 51 at the side edges. The first sheet 51 is intended to form the store 2 of the container 1 previously described and has at least one through window 180 at the first portion 52 or at the second portion 54. The through window 180 is intended to serve as a through opening 18 in the folded configuration of the blank 50. The blank 50 in the first embodiment (see FIG. 1) and in the third embodiment (see FIG. 9) has two through windows 180 defined at respective longitudinal ends of the second portion 54 of the first sheet 51, while the blank 50 in the second embodiment (see FIG. 6) has two through windows 180 defined at respective longitudinal ends of the first portion 52 of the first sheet 51.

The blank 50 also comprises a second sheet 57 joined in one piece to the first sheet 51 in correspondence of at least one edge 52*a*, 52*d* of the first portion 52 of the first sheet 51. The second sheet 57 comprises at least a first and a second portion 58, 59 joined together in one piece: the first portion 58 of the second sheet 57 is connected to the first sheet 51 such that the first portion 58 is arranged between the second portion 59 of the second sheet 57 and the first sheet 51. In the enclosed figures are shown by way of example, embodiments in which two second sheets 57 engaged to the first sheet 51 respectively at the lower edge 52*a* and at the upper edge 52*d* and arranged in opposition with respect to the first sheet 51 are provided. The second sheets 57 may be directly connected to the upper edge 52*d* and to the lower edge 52*a* of the first portion 52 of the first sheet 51 respectively. The first and second portions 58, 59 of the second sheet 57 are intended to respectively form the closure portion 9 and the inserting portion 10 of the closure system 7 of the container 1 described above.

The blank 50 also comprises at least a third sheet 60 joined in one piece to the first sheet 51 at one external edge of the second portion 54 of the first sheet. The third sheet 60 is intended to form the second coupling portion 13 of the safety device of the container 1 described above. The third sheet 60 comprises a first portion 61 and a second portion 62; the first portion 61 is intended to form the first panel 13*a* of the second coupling portion 13 and the second portion 62 is intended to form the second panel 13*b* of the second coupling portion 13. The attached figures illustrate embodiments of the invention in which the blank 50 comprises two thirds of the 60 sheets engaged on the first sheet 51 and arranged in opposition to the latter. The third sheet 60 may be directly connected to the upper edge 54*d* and to the lower edge 54*a* of the second portion 54 of the first sheet 51 respectively. Optionally, the third sheet has at least one opening 200 defined at the first portion 61 or at the second portion 62. In the blank sheet 50 according to the first embodiment (see FIG. 1) and in the blank sheet 50 according to the second embodiment (see FIG. 6), each third sheet 60 has at least one opening 200 defined between the first portion 61 and the second portion 62, at a creasing line defined between the first and second portions 61, 62. In contrast to the first and the second embodiment, in the blank 50 of the third embodiment (see FIG. 9) each third sheet 60 has an opening 200 entirely defined at the first portion 61.

The blank 50 also comprises at least a fourth sheet 63 joined by a piece on the second sheet 57 at the external edge of the second portion 59 of the second sheet 57. The fourth sheet 63 comprises at least a portion 64 intended to form the first coupling portion 12 of the safety device 11. In the attached figures embodiments of the invention in which the blank 50 comprises two forth sheets 63 engaged respective second sheets 57 and arranged opposite the first sheet 51 are shown. The fourth sheet 63 is configured to form the first coupling portion 12 of the safety device 11 of the container 1 previously described. The portion 64 of the fourth sheet 63 may be hook-shaped, such that forming the hook 15*a* of the first coupling portion 12. In the blank section 50 according to the first embodiment (see FIG. 1) and in the blank section 50 according to the second embodiment (see FIG. 6), each fourth sheet 63 has two portions 64 in hook-shaped, each of which defines the respective seats whose concavities face each other. In contrast to the first and second embodiments, in the blank 50 of the third embodiment (see FIG. 9) the portion 64 is intended to form a coupling portion 12 without hooks.

Container Manufacturing Process

It is also object of the present invention a process for making a container. The container 1 is made from a single blank 50 made of paper sheet material of the type previously described. As will be seen in detail in the following, the procedure involves folding the blank 50 and connection of some of its portions, for example by gluing, to form the container 1.

The procedure may include an engagement phase of a plastic film on at least part of the first prevalent development surface of the blank 50 and, in addition or alternatively, on the second prevalent development surface of the blank 50. The procedure also comprises a phase of creating a through window 180 at the first portion 52 or the second portion 54 of the first sheet 51. The through window 180 is intended to serve as a through passage 18 in the folded configuration of the blank 50. The through window 180 may be made by punching the first portion 42 or the second portion 54 of the first sheet 51. As an alternative to the realization phase of the through opening 180, the process may also include the preparation of a blank 50 already equipped with a through window 180. As an alternative to the preparation of a blank 50 already equipped with a through window 180, the procedure may provide for the preparation of a blank 50 configured to define a through window 180 or a through opening 18.

The process provides a predisposition of the store 2. Said involves folding the portions 52, 53, 54, 55, 56 and joining together the lateral connecting portions 55, 56, for example by gluing, to form the store 2, essentially defining a conduit or pipe laterally delimited by the side walls 4*a*, 4*b*, 4*c*, 4*d* and open at opposite longitudinal ends. Side walls 4*a*, 4*b*, 4*c*, 4*d* are defined by the first portion 52, the second portion 54, the central connecting portion 53 and the lateral connecting portions 55, 56 respectively. Being joined together, the side connection portions 55, 56 cooperate to form the fourth side wall 4*d*. In the following a possible folding sequence of the first sheet 51 related to realization of the store 2 is described.

Providing of store 2 may include a folding phase of the first sheet 51 at the side edges 52*b*, 52*c*, 54*b*, 54*c* of the portions 52 and 54. The forming phases of the store 2 initially involve folding a lateral connection portion, for example the portion 55, with respect to the first portion 52 and approaching the second portion 54. It is possible to provide the folding of the lateral connecting portion 55 such that the latter may define, in cooperation with the first portion 52, a substantially 'L' shape. Subsequently, the process involves, for example, folding the central connecting portion 53 with respect to the first portion 52 and approaching the already folded portion 55: for example, it is possible to provide the folding of the central connecting portion 53 such that the latter may define, in cooperation with the first portion 52, an essentially 'L' shape. Subsequently, it is possible to provide the folding of the second portion 54 with respect to the central connecting portion 53 and towards the first portion 52: for example, it is possible to provide the folding of the second portion 54 such that the latter may define, in cooperation with the middle portion 53, an essentially 'L' shape. For the entire formation of the store 2, the process involves folding the remaining portion of the lateral connecting portion, e.g. the portion 56, with respect to the second portion 54 such that it is possible to join the lateral connecting portions 55, 56. In order to maintain the store 2 in the folded three-dimensional form, the process may involves, but is not limited to, the application of a predetermined amount of glue to at least one lateral connecting portion 55, 56 act to be stopped each other: joining such portions 55, 56 allows to block the store 2 in the folded configuration. Optionally, a prefixed quantity of glue may be applied to both lateral connection portions 55, 56.

It is useful to specify that the preparation phase of the first sheet 51 may involves a crushing phase which allows to define on the same sheet folding lines coinciding with the longitudinal side edges of the portions of the first sheet 51. In fact, the folding phases of the portions 52, 53, 54, 55, 56 of the first sheet 51 take place right along the longitudinal side edges of the portions 52, 53, 54, 55, 56, which are crushed in order to facilitate their displacement by folding.

The procedure also provides for the preparation of the closure system 7. The preparation of closure system 7 involves folding the second portion 59 of the second sheet 57 with respect to the first portion 58 of the second sheet 57 and folding the first portion 58 of the second sheet 57 with respect to the first portion 52 of the first sheet 51 such as forming the closure portion 9 and the inserting portion 10 of the closure system 7 previously described.

The procedure also comprises the preparation of safety device 11. This stage involves folding the third sheet 60 and the fourth sheet 63. The first portion 61 of the third sheet 60, during the formation phase of the store, is folded against the second portion 54 of the first sheet 51 and is joined to it, e.g. by gluing. The procedure may provide, as a non-limiting measure, for the application of a prefixed quantity of glue on at least one between the first portion 61 of the third sheet 60 and a part of the second portion 54 of the first sheet 51 act for stopping to each other: the union of these portions allows the definition the second coupling portion 13 of the safety device 11 previously described. Optionally, a prefixed quantity of glue may be applied both on the first portion 61 of the third sheet 60 and on a part of the second portion 54 of the first sheet 51. Optionally, the second coupling portion 13 is defined by folding the second portion 62 of the third sheet 60 away from the second portion 54 of the first sheet 51 and from the first portion 61 of the third sheet 60.

The manufacturing process of container 1 may also include a phase of engaging the fourth sheet 63 forming the first coupling portion 12 to the second coupling portion 13 previously formed by folding and gluing the third sheet 60 to define the closing condition of the closure system 7.

Container Opening Method

The present invention also relates to a method of opening the container 1. The method of opening the container 1 involves providing a container 1 according to any of the embodiments described above. The previously provided container 1 has the closure system 7 in closing condition.

The method of opening the container 1 involves inserting at least partially an opening device 19 into the internal volume 3 of store 2 through the through access 18. The opening device 19 enters the internal volume 3 of store 2 and contacts the safety device 11, determining a relative movement between the first coupling portion 12 and the second coupling portion 13 act to allow the disengagement between the first and second coupling portions 12, 13; consequently, the closure system 7 switches from the closing to the opening condition.

The opening method may involve contacting and moving the second coupling portion 13 by means of the opening device 19, in such a way that determines at least a partial rotation of the second coupling portion 13 with respect to the first coupling portion 12 is achieved and consequently disengaging the first coupling portion 12 from the second coupling portion 13. The movement of the second coupling portion 13 with respect to the first coupling portion 12 allows the undercut 15 of the first coupling portion 12 to disengage from undercut 16 of the second coupling portion 13 and may take place by rotation of the second panel 13*b* of the second coupling portion 13.

In more detail, the opening method may provide for the insertion of the opening device 19 through the through access 18 defined in correspondence of the second side wall 4*b* and provides for contacting and moving, through the opening device 19, the second coupling portion 13 such as to determine a rotation of the second coupling portion 13 with respect to the first coupling portion 12. This rotation determines the disengagement of the first coupling portion 12 from the second coupling portion 13. As shown in FIG. 3B, the contact of the opening device 19 on the second coupling portion 13 takes place at the unlocking appendix 21, as previously described with reference to the first embodiment of the container 1.

Alternatively, the method may involve inserting the opening device 19 through the through access 18 defined at the first side wall 4*a*. As shown in FIG. 8, the contact of opening device 19 on the second coupling portion 13 takes place at the second panel 13*b*.

Figure 12:
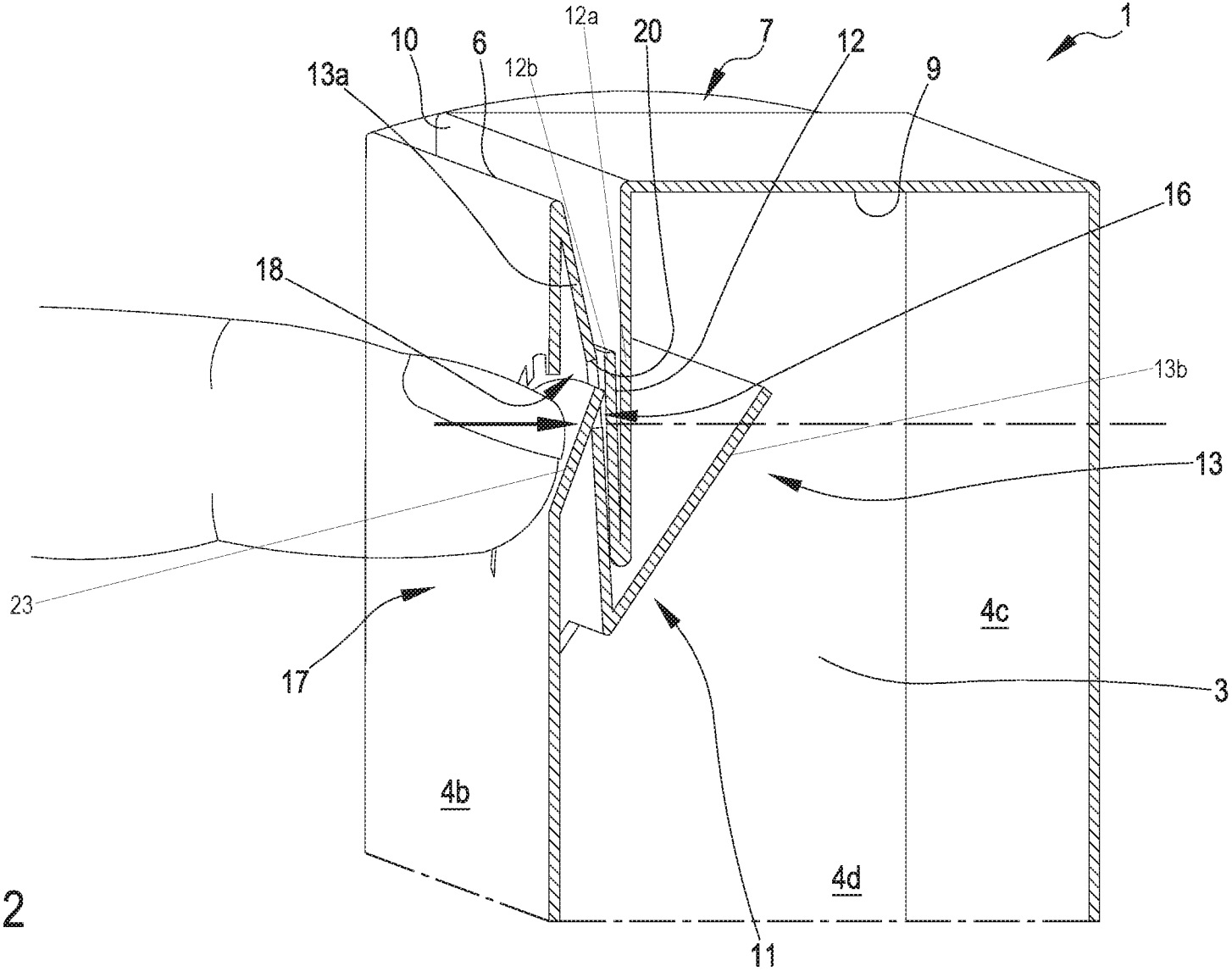
FIG. 12 is a section of the container in FIG. 11.

The opening method may also include inserting the opening device 19 through the through access 18 defined at of the second side wall 4*b* and also provides to contact and move, through the opening device 19, the first coupling portion 12 so as to move the first coupling portion 12 with respect to the second coupling portion 13 and consequently disengage the first coupling portion 12 from the second coupling portion 13. The displacement of the first coupling portion 12 with respect to the second coupling portion 13 allows the first coupling portion 12 to disengage from the undercut 16 of the second coupling portion 13 and it may take place by rotation or translation or roto-translation of the first coupling portion 12. FIG. 10A and FIG. 12 illustrate for example, the phase of disengagement of the first coupling portion 12 from the second coupling portion 13.

The phase that involves inserting at least partially an opening device 19 into the internal volume 3 of the store 2 through the through access 18 of a container 1 may be carried out by manually operating the thrust portion 23 or a flap of the unlocking portion. Such manual operation may be carried out by a user by inserting, for example, at least part of a finger at through access 18; in such embodiments, the user's finger essentially acts as an opening device 19.

After the disengagement of the first coupling portion 12 from the second coupling portion 13, the method provides the movement of the closure system 7 by rotation around the free edge 6 of the store 2, determining the opening of container 1. FIG. 10B illustrates for example, with reference to the third embodiment of the container 1, the opening phase of the container 1 in which the inserting portion 10 is moved by rotation, starting from the configuration of FIG. 10A, away from the internal volume 3 of the container 1.

The invention claimed is:

1. A childproof container comprising:

a store made of sheet material defining an internal volume configured to house at least one product, the store having a prefixed number of side walls defining at least one passage opening delimited by a free edge, said passage opening being configured to put in communication the internal volume of the store with the external environment, at least one closure system also made of sheet material engaged at the free edge and movable with respect to the store, the closure system being configured to define at least one closing condition in which the closure system itself interdicts the communication between the internal volume of the store and the external environment, the closure system being also configured to define an opening condition in which the closure system itself allows the communication between the internal volume and the external environment, at least a safety device made of sheet material exhibiting:

at least a first coupling portion carried by the closure system, at least a second coupling portion engaged to the store and configured to cooperate with said first coupling portion, wherein the first and second coupling portions are configured to stably engage with each other in the internal volume of the store in the closing condition of the closure system to define a locking condition of the safety device in which said first and second coupling portions prevent the closure system from switching from the closing to the opening condition, wherein the store comprises at least an unlocking portion defined on at least one side wall of said prefixed number of side walls, said unlocking portion being configured to define at least one through access, said through access being configured to allow, at least in the locking condition of the safety device, the disengagement between the first and the second coupling portions and consequently the passage of the closure system from the closing condition to the opening one; and wherein the through access of the unlocking portion at least partly directly facing the second coupling portion.

2. The container according to claim 1, wherein the through access of the unlocking portion is spaced from the free edge of the store.

3. The container according to claim 1, wherein the second coupling portion is directly carried by at least one side wall of said prefixed number of side walls of the store, wherein the second coupling portion is entirely arranged in the internal volume of the store.

4. The container according to claim 1, wherein the closure system emerges in extension from a first side wall of said prefixed number of side walls, the second coupling portion being directly carried by a second side wall of said prefixed number of side walls and being entirely arranged in the internal volume of the store, wherein the second side wall of the store directly carrying the second coupling portion is opposed to the first side wall of the store from which the closure system emerges, wherein the first side wall is a front wall of the store while the second side wall is a rear wall of the store.

5. The container according to claim 1, wherein the through access of the unlocking portion is configured to allow, in the locking condition of the safety device, the access to the internal volume to allow the disengagement between the first and second coupling portions, wherein the through access of the unlocking portion is configured to allow, at least in the locking condition of the safety device, at least the partial insertion of an opening device and/or at least a user finger into the internal volume of the store allowing the intervention on the safety device and disengage the first and second coupling portions.

6. The container according to claim 1, wherein the through access comprises an opening through the side wall of the store, wherein the through access is delimited by a closed profile, the through access being distanced from the free edge of the store.

7. The container according to claim 1, wherein the unlocking portion comprises at least a thrust portion movable between:

a thrust condition, in which the thrust portion acts on the safety device allowing the disengagement between the first and second coupling portions, and a rest condition, in which the thrust portion is distanced from the safety device.

8. The container according to claim 7, wherein the through access of the unlocking portion defines a substantially "C" or "V" or "U" shape having a predetermined concavity, wherein the thrust portion defines at least part of an external side wall of the store, wherein the thrust portion is arranged at least inside the concavity defined by the through access of the unlocking portion.

9. The container according to claim 7, wherein the thrust portion is configured to be moved from the thrust condition to rest condition manually by a user, wherein the thrust portion is configured to act in thrust directly on at least one between the first and second coupling portions.

10. The container according to claim 1, wherein the second coupling portion comprises a first and a second panel joined in one piece, the first and second panels of the second coupling portion being folded around a folding edge defining a folded tab having a substantially "V" shape, wherein the V-shape folded tab of the second coupling portion has a concavity facing outwards from the container, wherein the first panel of the second coupling portion is directly connected to the front wall of the store while the second panel is directly connected to the first panel, wherein the second coupling portion comprises a through opening configured to allow, at least in the closing condition of the closure system, the passage of at least one part of the first coupling portion allowing the engagement of the first coupling portion to the second coupling portion in order to define the locking condition, wherein the through opening is defined at the folding edge of the first and second panels.

11. The container according to claim 10, wherein the through opening is defined at least partially on the second panel and at the folding edge.

12. The container according to claim 11, wherein the through opening defined at least partly on the second panel of the second coupling portion defines on said second panel at least one hook configured to stably engage said first coupling portion, the hook defined on the second panel of the second coupling portion defining a seat suitable for receiving in crossing the first coupling portion during the passage of the closure system from the opening condition to the closing one, wherein the first coupling portion comprises at least one respective hook configured to constrain the hook defined on the second panel of the second coupling portion.

13. The container according to claim 12, wherein the first and second panels of the second coupling portion are movable with respect to each other at least between:

a locking position in which the first and second panels are angularly offset each other and configured to prevent the first coupling portion, in the locking condition, to come out from the through opening of the second coupling portion, thus preventing the disengagement between the first and second coupling portions, a release position in which the first and the second panels are, at least in part, substantially parallel to each other and configured to allow the release the first coupling portion to come out from the through opening of the second coupling portion thus allowing the disengagement between the first and second coupling portion.

14. The container according to claim 13, wherein at least one between the first and second panels of the second coupling portion comprises an unlocking appendix configured to allow the relative movement of the first and second panel between the locking position and the release position, wherein the through access is directly facing the appendix and is configured to allow a user to act in thrust on the appendix to move the first and second panel from the locking position to the release position.

15. The container according to claim 10, wherein the through opening is defined on the first panel of the second coupling portion, where the through opening defines an undercut, wherein the first coupling portion is configured to engage the undercut at least in the locking condition of the safety device.

16. The container according to claim 15, wherein the through opening is spaced from the folding edge of the first and second panels.

17. The container according to claim 15, wherein the first coupling portion comprises a respective folded portion defined by a respective first and second panels, wherein the first and second panels of the first coupling portion define a folded portion with a substantially "V" shape whose concavity, in the closing condition of the closure system, faces outwards from the container, wherein the second panel of the first coupling portion, in the closing condition of the closure system, is configured to at least partially pass through the through opening defined on the first panel of the second coupling portion to define the locking condition of the safety device.

18. The container according to claim 17, wherein the through access, in the locking condition, directly facing the first panel of the second coupling portion and it is configured to allow a user to act in thrust directly on the first coupling portion to allow the latter to disengage from the second coupling portion.

* * * * *